US007000580B1

(12) United States Patent
Smith et al.

(10) Patent No.: US 7,000,580 B1
(45) Date of Patent: Feb. 21, 2006

(54) CONTROL VALVES WITH INTEGRATED CHECK VALVES

(75) Inventors: Franklin R. Smith, Cortland, NY (US); Peter Chapman, Lecco (IT); Braman Wing, Interlaken, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/952,054

(22) Filed: Sep. 28, 2004

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

| | | | | |
|---|---|---|---|---|
| 1,953,547 A | * | 4/1934 | Wolff | 137/533.17 |
| 3,424,319 A | | 1/1969 | Hohlfelder | 214/1 |
| 3,528,328 A | | 9/1970 | Jeanneret | 82/36 |
| 3,619,898 A | | 11/1971 | Perry et al. | 29/568 |
| 3,975,817 A | | 8/1976 | Frazier | 29/568 |
| 4,607,764 A | * | 8/1986 | Christine | 222/207 |
| 5,002,023 A | | 3/1991 | Butterfield et al. | 123/90.15 |
| 5,107,804 A | | 4/1992 | Becker et al. | 123/90.17 |
| 5,172,659 A | | 12/1992 | Butterfield et al. | 123/90.17 |
| 5,207,192 A | * | 5/1993 | Smith | 123/90.17 |
| 5,218,935 A | | 6/1993 | Quinn, Jr. et al. | 123/90.17 |
| 5,289,805 A | | 3/1994 | Quinn, Jr. et al. | 123/90.17 |
| 5,291,860 A | | 3/1994 | Quinn, Jr. | 123/90.17 |
| 5,361,735 A | | 11/1994 | Butterfield et al. | 123/90.17 |
| 5,386,807 A | | 2/1995 | Linder | 123/90.17 |
| 5,417,241 A | | 5/1995 | Tischer et al. | 137/596.17 |
| 5,497,738 A | | 3/1996 | Siemon et al. | 123/90.17 |
| 5,657,725 A | | 8/1997 | Butterfield et al. | 123/90.17 |
| 5,666,914 A | * | 9/1997 | Ushida et al. | 123/90.17 |

(Continued)

FOREIGN PATENT DOCUMENTS

EP 1447602 8/2004

(Continued)

OTHER PUBLICATIONS

Automotive Handbook, Bosch, "Electrohydraulic Pumps and Small Units", pp. 634-637.

(Continued)

*Primary Examiner*—Thomas Denion
*Assistant Examiner*—Zelalem Eshete
(74) *Attorney, Agent, or Firm*—Brown & Michaels, PC; Greg Dziegielewski

(57) ABSTRACT

A spool valve for variable cam timing phaser comprising a spool, a plurality of check valves and passages from the advance chamber and the retard chamber to a port in the spool valve. The spool having at least two lands separated by a central spindle, slidably mounted within a bore. When the spool is in the first position, fluid from the advance chamber flows through the passage and the port to the bore surrounding the central spindle of the spool valve and through a check valve and port to the passage to the retard chamber. When the spool is in the second position, fluid from the retard chamber flows through the passage and the port to the bore surrounding the central spindle of the spool valve and through a check valve and port to the passage to the advance chamber.

49 Claims, 27 Drawing Sheets

U.S. PATENT DOCUMENTS

| | | | | |
|---|---|---|---|---|
| 6,047,674 | A * | 4/2000 | Kadowaki et al. | 123/90.15 |
| 6,247,434 | B1 | 6/2001 | Simpson et al. | 123/90.17 |
| 6,250,265 | B1 | 6/2001 | Simpson | 123/90.17 |
| 6,263,843 | B1 * | 7/2001 | Todo et al. | 123/90.17 |
| 6,263,846 | B1 | 7/2001 | Simpson et al. | 123/90.17 |
| 6,311,655 | B1 | 11/2001 | Simpson et al. | 123/90.17 |
| 6,374,787 | B1 | 4/2002 | Simpson et al. | 123/90.17 |
| 6,763,791 | B1 | 7/2004 | Gardner et al. | 123/90.17 |
| 2003/0070713 | A1 | 4/2003 | Cornea et al. | 137/512.15 |

FOREIGN PATENT DOCUMENTS

| | | | |
|---|---|---|---|
| JP | 07280788 | A | 10/1995 |
| JP | 11013430 | A | 1/1999 |

OTHER PUBLICATIONS

Pictorial Handbook of Technical Devices, Grafstein et al, "C-Valves", 2 pages.

* cited by examiner

CONTROL VALVES WITH INTEGRATED CHECK VALVES

BACKGROUND OF THE INVENTION

1. Field of the Invention

The invention pertains to the field of variable cam timing. More particularly, the invention pertains to controlling the phaser to vary the timing of the cam using the spool valve.

2. Description of Related Art

U.S. Pat. No. 5,002,023 shows a single check valve in a spool valve which is present in the rotor.

U.S. Pat. No. 5,172,659 shows dual check valves in the rotor between the chambers and the spool valve. A single check valve is present in the spool itself.

U.S. 2003/0070713A1 discloses a valve arrangement having a valve member in a cylindrical sleeve, where the sleeve has several bores in which hydraulic medium can flow through. A rectangular strip-shaped member made of springs steel surrounds a bore of the sleeve, sealing the bore. The strip-shaped member expands when the hydraulic pressure reaches a certain pressure.

JP11013430A discloses a selector mechanism in the middle of an oil pressure passage in the camshaft. Two check valves are present in the selector mechanism. Each check valve has a ball, received by a seat in a body that is slanted. A slidable selecting piston slides back and forth between the two check valves and first with the slant present on the check valve body, allowing fluid to move through only one check valve at a time to a hydraulic chamber.

The "Pictorial Handbook of Technical Devices" by Grafstein & Schwarz on pages 376–377 shows a shuttle valve, identified by "d". As shown in "d", the valve has two inlets and one outlet. Two check valves block low pressure from the sides of the valve. Shuttle valves are commonly used to isolate a normal operating system from an alternate/emergency system. So, one of the inlets is to the normal operating system and the other is for the emergency system. The shuttle slides and blocks the emergency inlet during normal operation by normal system pressure. The emergency inlet remains blocked until the emergency system is activated. At this time, the shuttle moves, blocking the normal system inlet, allowing free flow from the emergency inlet to the outlet.

The $2^{nd}$ edition of the "Automotive Handbook" by Bosch, pages 634–636 discloses a spool valve comprising a valve body, a load, metering notches, a spool a, a check valve, and a return spring. The check valve is located in the body of the spool and acts as a one way flow device for the inlet line of the spool valve. On pages 636 & 637, a hydraulically unlockable double check valve is shown. The valve comprises a poppet valve, an unlockable piston and two check valves. The check valve may be opened mechanically, hydraulically, or electrically.

SUMMARY

A spool valve for variable cam timing phaser comprising a spool, a plurality of check valves and passages from the advance chamber and the retard chamber to a port in the spool valve. The spool having at least two lands separated by a central spindle, slidably mounted within a bore in the rotor. When the spool is in the first position, fluid from the advance chamber flows through the passage and the port to the bore surrounding the central spindle of the spool valve and through a check valve and port to the passage to the retard chamber. When the spool is in the second position, fluid from the retard chamber flows through the passage and the port to the bore surrounding the central spindle of the spool valve and through a check valve and port to the passage to the advance chamber.

Additionally, the spool valve may also by externally or internally connected to a stationary rotary actuator. In the rotary actuator, the housing does not have an outer circumference for accepting drive force and motion of the housing is restricted. The restriction of the housing ranges from not moving the housing at all to the housing having motion restricted to less than 360°. All movement, other than the twisting of the shaft is done by the rotor. The rotor and the vane moves or swings through the distance as defined and limited by the housing. All of the cyclic load is on the rotor and the rotor accepts all of the drive force.

DETAILED DESCRIPTION OF THE INVENTION

Figure 1A:
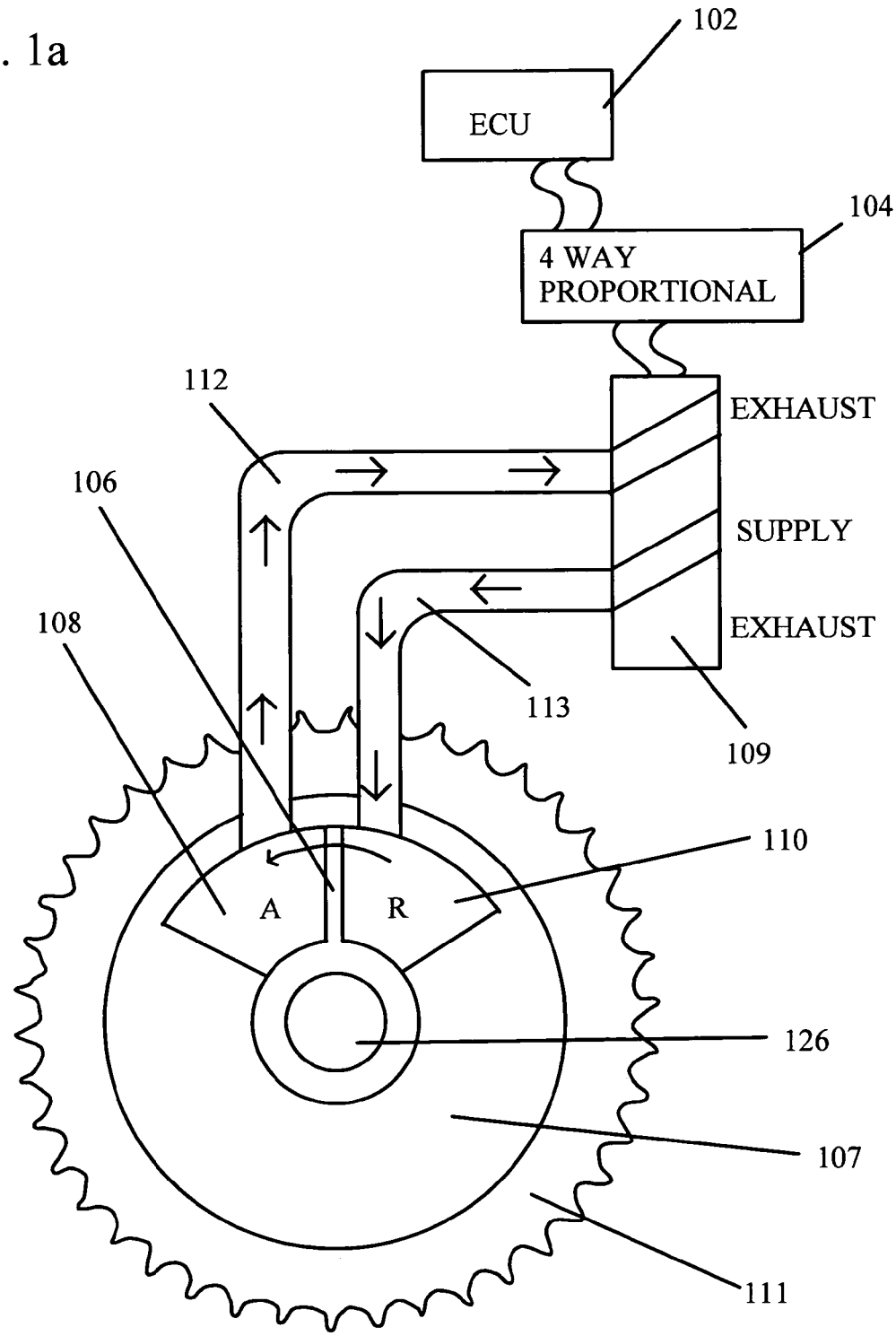
FIG. 1*a* shows a schematic of an oil pressure actuated (OPA) phaser shifting to retard.
Figure 1B:
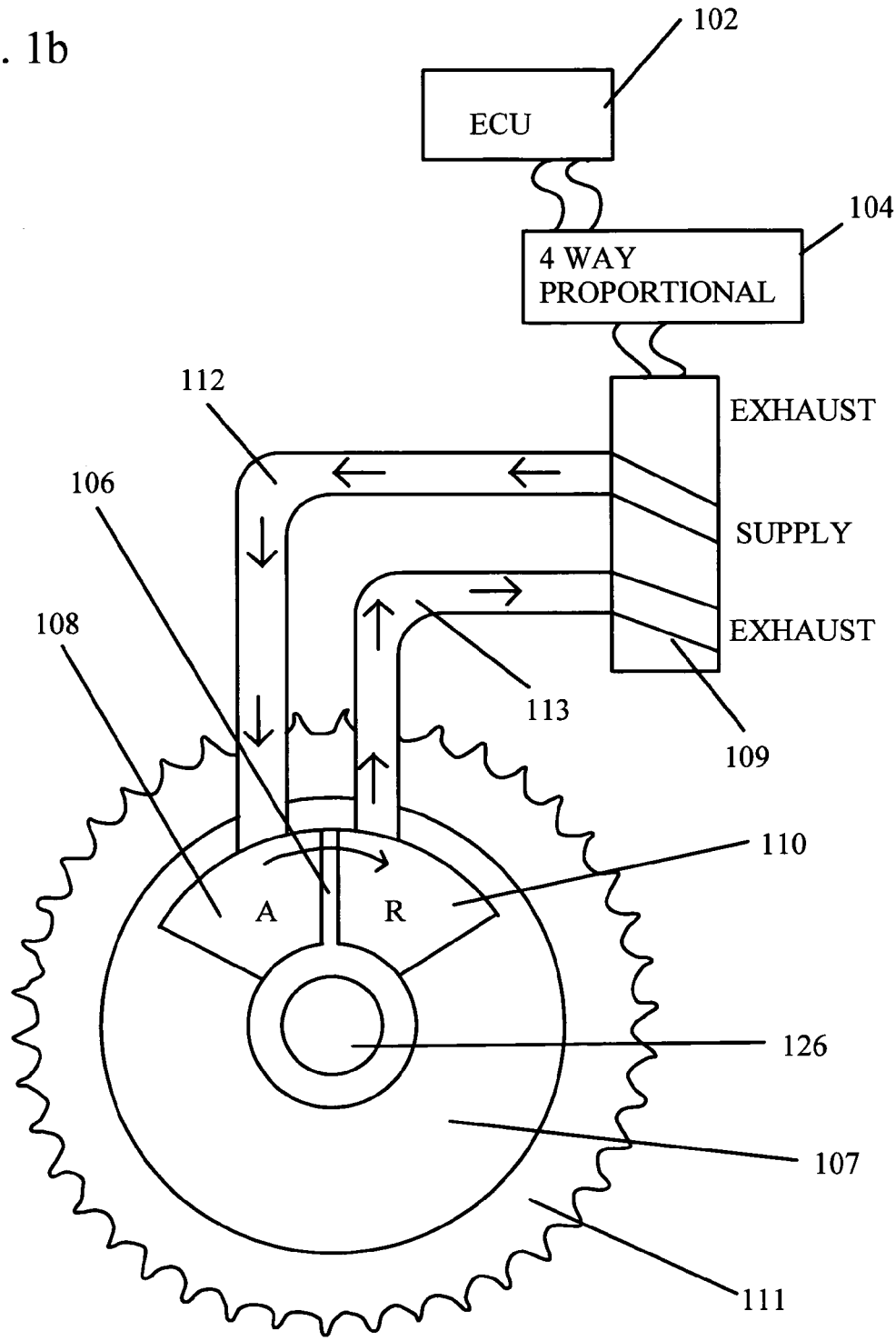
FIG. 1*b* shows a schematic of an oil pressure actuated (OPA) phaser shifting to advance.
Figure 1C:
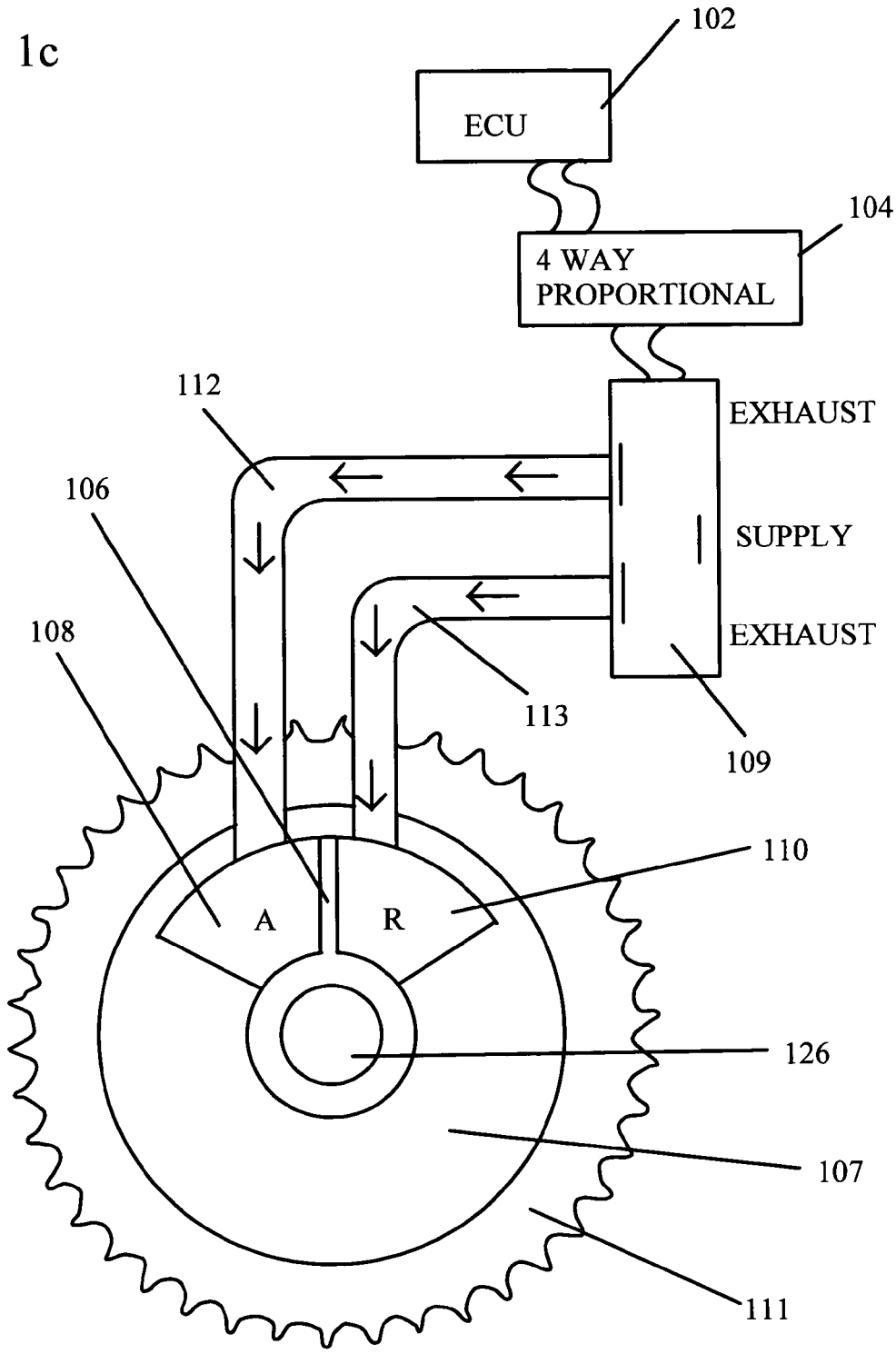
FIG. 1*c* shows a schematic of an oil pressure actuated (OPA) phaser in the null position.

Referring to FIGS. 1*a* through 1*c*, a conventional oil pressure actuated phaser, where engine oil pressure is applied to a chamber 108, 110 on one side of the vane 106 or the other by a control valve 104, 109. The housing 111 has an outer circumference for accepting drive force. The rotor 107 is connected to the camshaft 126 coaxially located in the housing 111. The housing 111 and the rotor 107 define at least one vane 106 separating a chamber in the housing 111 into an advance chamber 108 and a retard chamber 110. The vane 106 is capable of rotation to shift the relative angular position of the housing 111 and the rotor 107. The control valve 104, 109 may be internally or externally mounted and may consist of a variable force solenoid (VFS) controlled by an ECU 102, the spool valve 104, 109, also known as a four-way valve, and sleeve (not shown). In this case, the spool valve is mounted remotely. Oil from an opposing chamber 108, 110 is exhausted back to the oil sump through lines 112, 113. The applied engine oil pressure alone is used to move the vane 106 in the advance direction or the retard direction. To retard the phaser, as shown in FIG. 1*a*, pressure is applied to the retard chamber 110 to the retard the camshaft and simultaneously exhausting chamber 108. Higher oil pressure increases the retard actuation rate. To advance the phaser, as shown in FIG. 1*b*, pressure is applied to the advance chamber 108 to advance the camshaft. Higher oil pressure increases the advance actuation rate. The oil that is controlled by the four-way valve 104, 109 communicates with the chambers via the two lines 112, 113 in the camshaft, one for retarding the vane 106, as shown in FIG. 1*a* and one for advancing the vane 106, as shown in FIG. 1*b*. FIG. 1*c* shows the phaser in the null position where the phase angle is being maintained and pressure and fluid are blocked from both the advance and retard chambers 108, 110. Because of torque reversals in the camshaft, the graph of movement of an OPA phaser looks similar to a sine wave. One of the disadvantages of the OPA phaser is that the performance of the phaser is directly related to the oil pump capacity and requires a constant supply of oil.

Figure 2A:
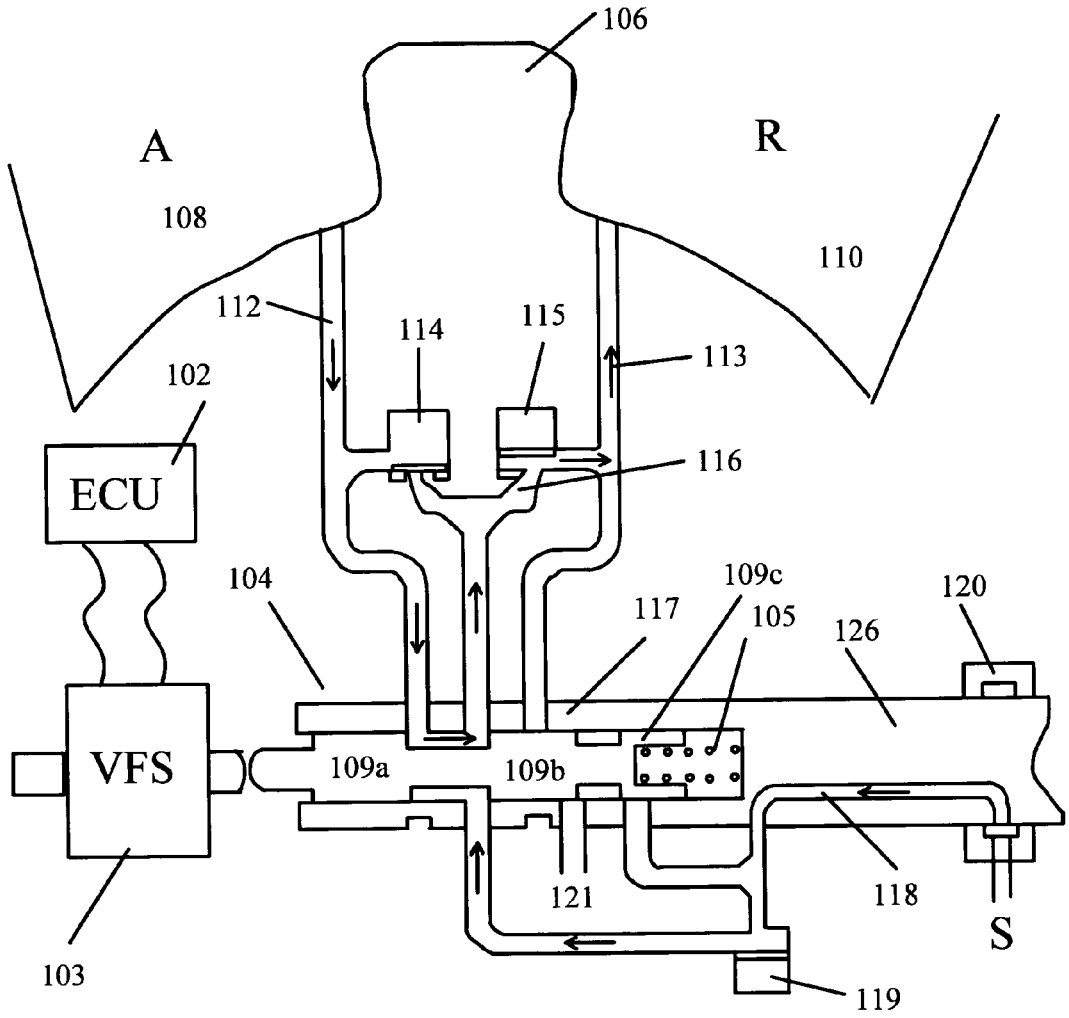
FIG. 2*a* shows a schematic of a cam torque actuated (CTA) phaser shifting to retard.
Figure 2B:
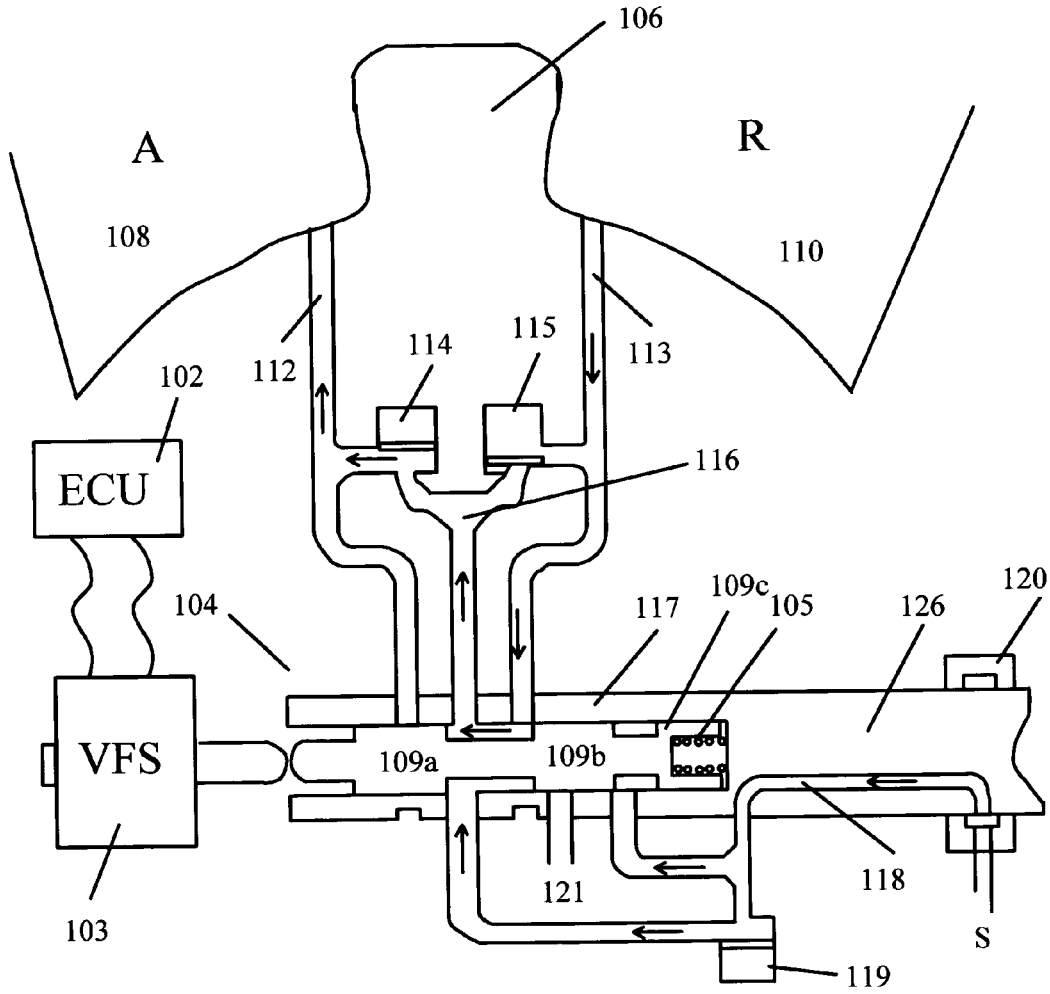
FIG. 2*b* shows a schematic of a cam torque actuated (CTA) phaser shifting to advance.
Figure 2C:
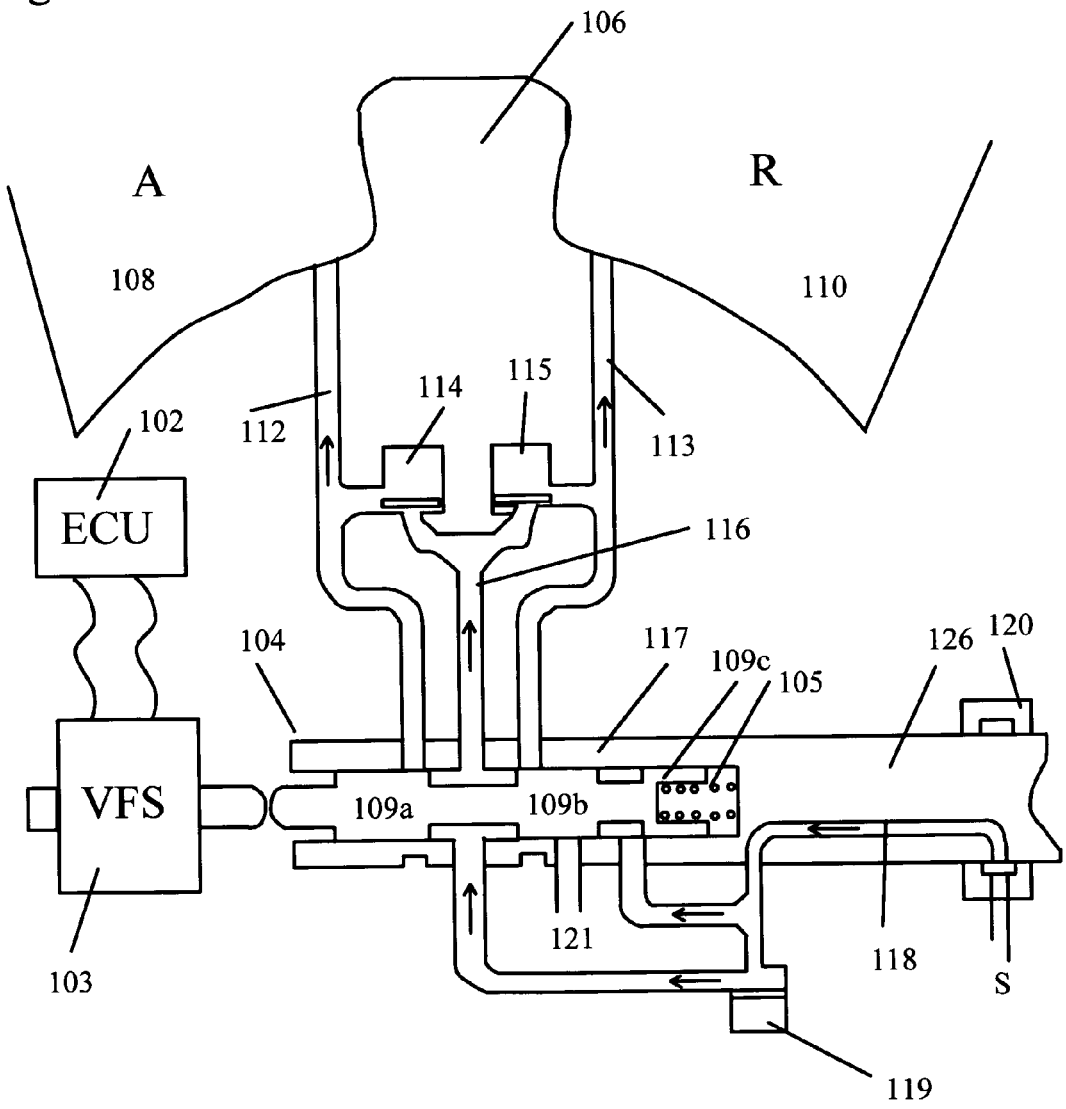
FIG. 2*c* shows a schematic of a cam torque actuated (CTA) phaser in the null position.

FIGS. 2*a* through 2*c* show a conventional cam torque actuated phaser (CTA). Torque reversals in the camshaft caused by the forces of opening and closing engine valves move the vanes 106. The control valve in a CTA system allows the vanes 106 in the phaser to move by permitting fluid flow from the advance chamber 108 to the retard chamber 110 or vice versa, depending on the desired direction of movement as shown in FIGS. 2*a* and 2*b*. Positive cam torsionals are used to retard the phaser, as shown in FIG. 2*a*. Negative cam torsionals are used to advance the phaser, as shown in FIG. 2*b*. A null or central position, as shown in FIG. 2*c*, stops the flow of fluid, locking the vane in position.

More specifically, in the retard position of the phaser, as shown in FIG. 2*a*, hydraulic fluid from the supply enters line 118 and moves through check valve 119 to the spool valve 104. As shown in the schematic, the spool valve 104 is internally mounted and comprises a sleeve 117 for receiving a spool 109 with lands 109*a*, 109*b*, 109*c* and a biasing spring 105. One of the advantages of locating the hydraulic control inside of the phaser, is the decrease in the amount of modification of the engine required. A VFS 103, which is controlled by an ECU 102, moves the spool 109 within the sleeve 117. For the retard position, as shown in FIG. 2*a*, the spool 109 is moved to the left by spring 105, and spool land 109*b* blocks line 113 and most of exhaust line 121, spool land 109*c* blocks another exhaust line, and line 112 and 116 are open. From the spool 109, fluid enters line 116 through open check valve 115 and moves into line 113 and to the retard chamber 110. At the same time fluid is exiting the advance chamber through line 112 and the fluid moves through the spool between lands 109*a* and 109*b*, and back into line 116 where it feeds into line 113 supplying fluid to the retard chamber. In addition, as stated earlier positive cam torsionals are used to aid in moving the vane 106.

To advance the phaser, as shown in FIG. 2*b*, the spool is moved by the VFS 103 to the right, so that spool land 109*a* and 109*b* do not block line 113, line 116, or any exhaust lines and spool land 109*a* blocks the exit of fluid from line 112. Fluid from the retard chamber 110 exits the chamber through line 113, which routes the fluid through the spool 109 between lands 109*a* and 109*b*. The fluid then enters line 116 and travels through open check valve 114 into line 112 and the advance chamber 108. In addition, as stated earlier only cam torsionals are used to move the vane 106. Additional fluid is supplied by the supply through line 118 and check valve 119 to the spool valve 104.

FIG. 2*c* shows the phaser in null or a central position where the spool lands 109*a*, 109*b* block lines 112 and 113 and vane 106 is locked into position. Additional fluid is provided to the phaser to makeup for losses due to leakage.

The primary operation differences between an OPA phaser and a CTA phaser, is that the oil pressure actuated phaser exhausts oil back to the sump when the vane is actuating, whereas the cam torque actuated phaser exhaust oil from one chamber directly to the other chamber, and therefor recirculates the oil inside the phaser while it is actuated. Advantages of the CTA phaser over the OPA phaser are that the CTA phaser uses the cam torsionals to assist in moving the vane and reciruclates oil, increasing efficiency and performance of the phaser, so that the performance is not relying on the pump capacity.

Figure 3:
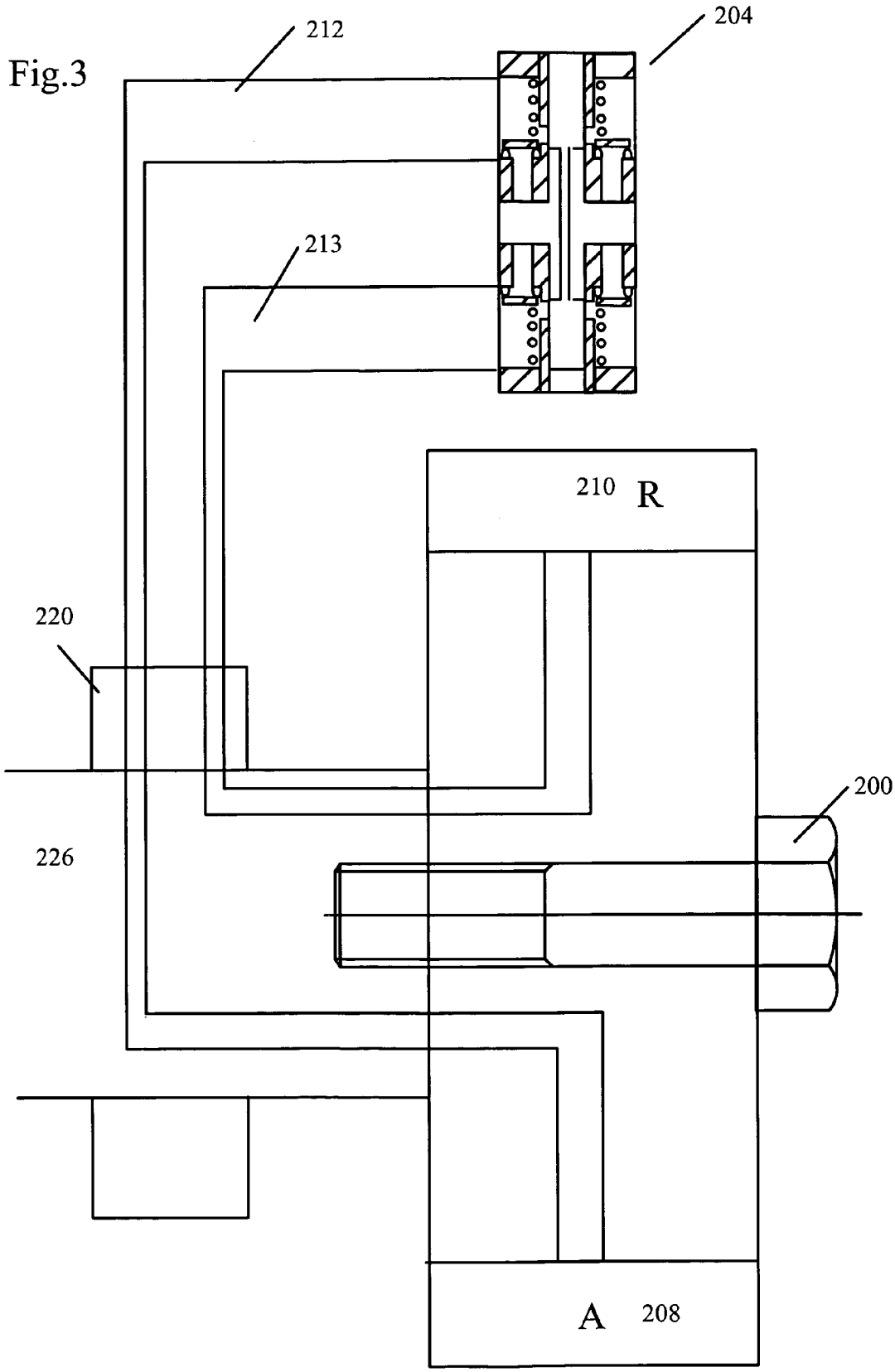
FIG. 3 shows an externally mounted spool valve with check valves in the sleeve of the spool valve.
Figure 4:
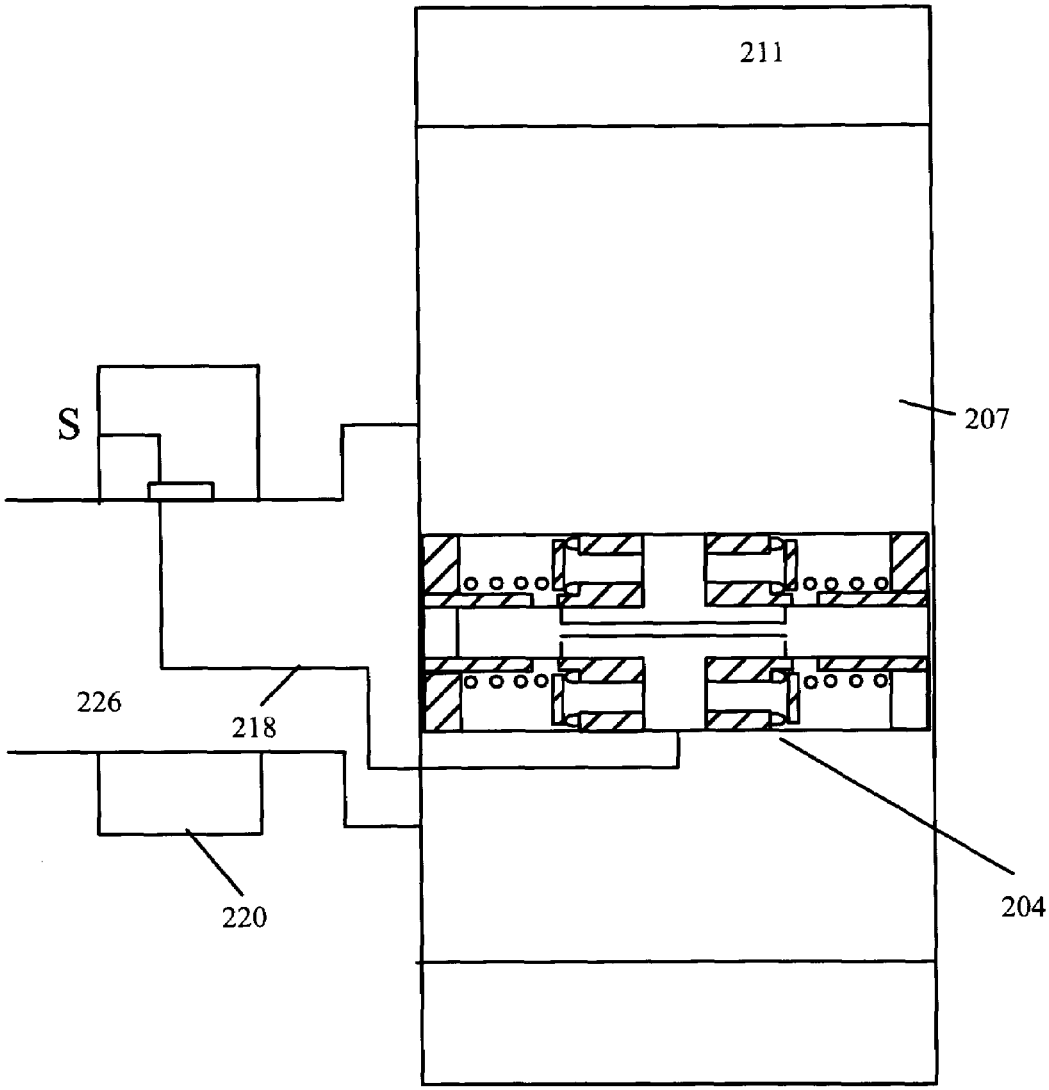
FIG. 4 shows an internally mounted spool valve with check valves in the sleeve of the spool valve.

FIGS. 3 through 6*d* shows a remotely mounted control valve for an oil pressure actuated phaser of the present invention. The control valve includes the variable force solenoid (VFS) 103, the spool valve 104 and the sleeve 117, which are replaced with the spool valve 204 shown in FIG. 5. The spool valve 204 may be externally mounted or internally mounted as shown in FIGS. 3 and 4. FIGS. 3 and 4 do not show the supply line, or the VFS. FIG. 4 shows the spool valve 204 mounted externally. Two lines, 212, 213 run from the spool valve 204 through the cam bearing 220 of the camshaft 226, into the rotor 207 and housing 211 to the retard chamber 210 and the advance chamber 208. The lines 212, 213 are usually present on either side of a bolt 200 when the spool valve 204 is externally mounted. One of the advantages of externally mounting the spool valve is that the room required or the room that the phaser takes up in the engine is smaller and is shorter overall in length.

FIG. 4 shows the spool valve 204 mounted internally. The spool valve 204 is located in the center of the rotor 207. Supply provides hydraulic fluid to spool valve 204 through line 218, which enters the phaser through the cam bearing 220 of the camshaft 226 and into the in the rotor 207 where the spool valve 204 is present. One of the advantages of internally mounting the spool valve 204 is the reduction of leakage of the phaser.

Figure 5:
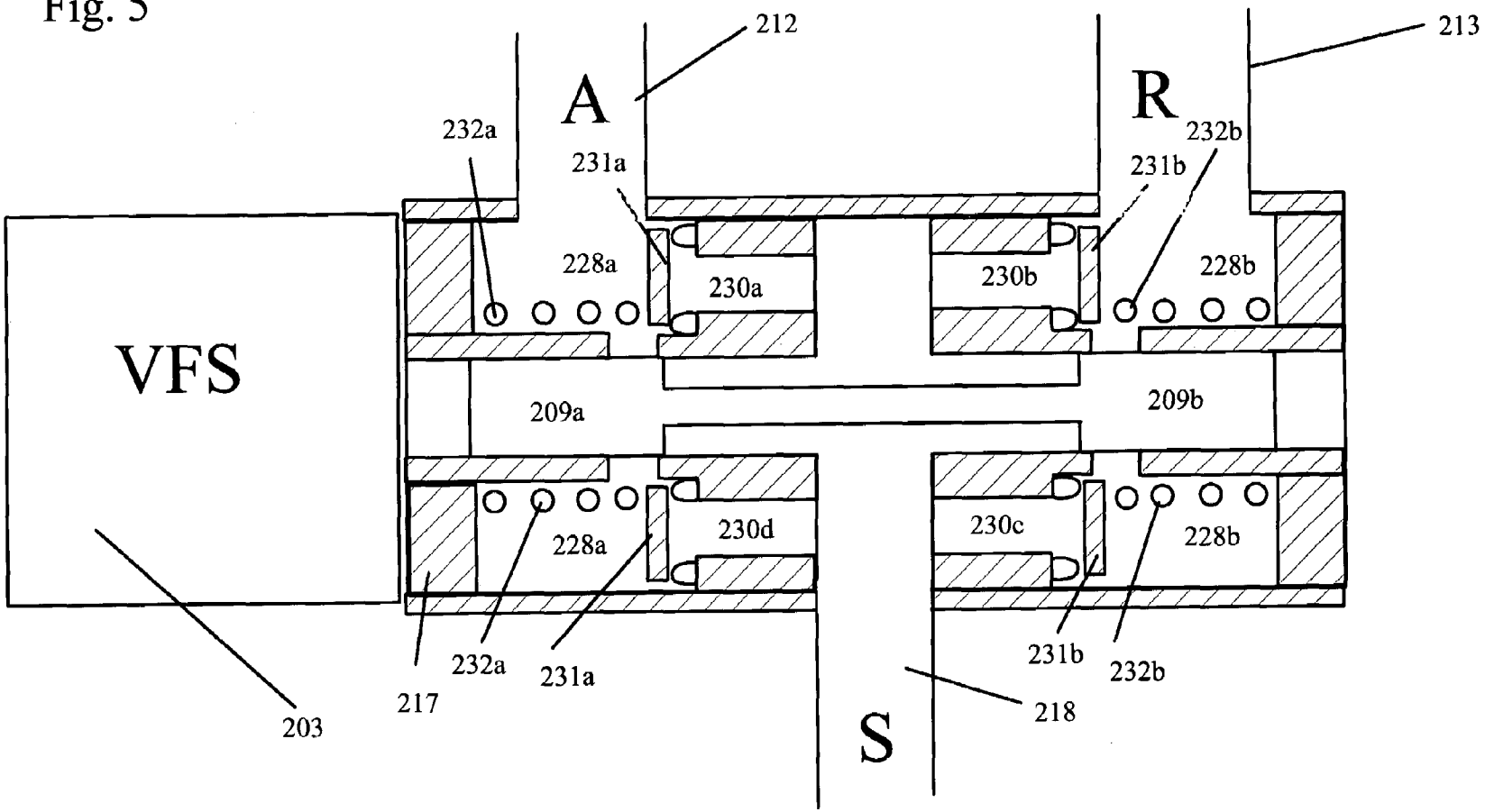
FIG. 5 shows a close-up of the spool valve.

FIG. 5 shows a close-up of the spool valve 204. The spool 209 is comprised of lands 209*a* and 209*b* separated by a central spindle and is surrounded by a cylindrical sleeve 217. Within the cylindrical sleeve 217 are at least two check valves, an advance check valve 228*a*, and a retard check valve 228*b*, each having one or more passages 230*a*, and 230*d* for the advance check valve 228*a* and passages 230*b* and 230*c* for the retard check valve. Each of the check valves 228*a*, 228*b* is comprised of a disk 231*a*, 231*b*, and a spring 232*a*, 232*b*, respectively. Other types of check valves may be used, including band check valves, ball check valves, and cone-type. The VFS 203 actuates the spool valve 204 and is biased by a spring not shown.

Figure 6A:
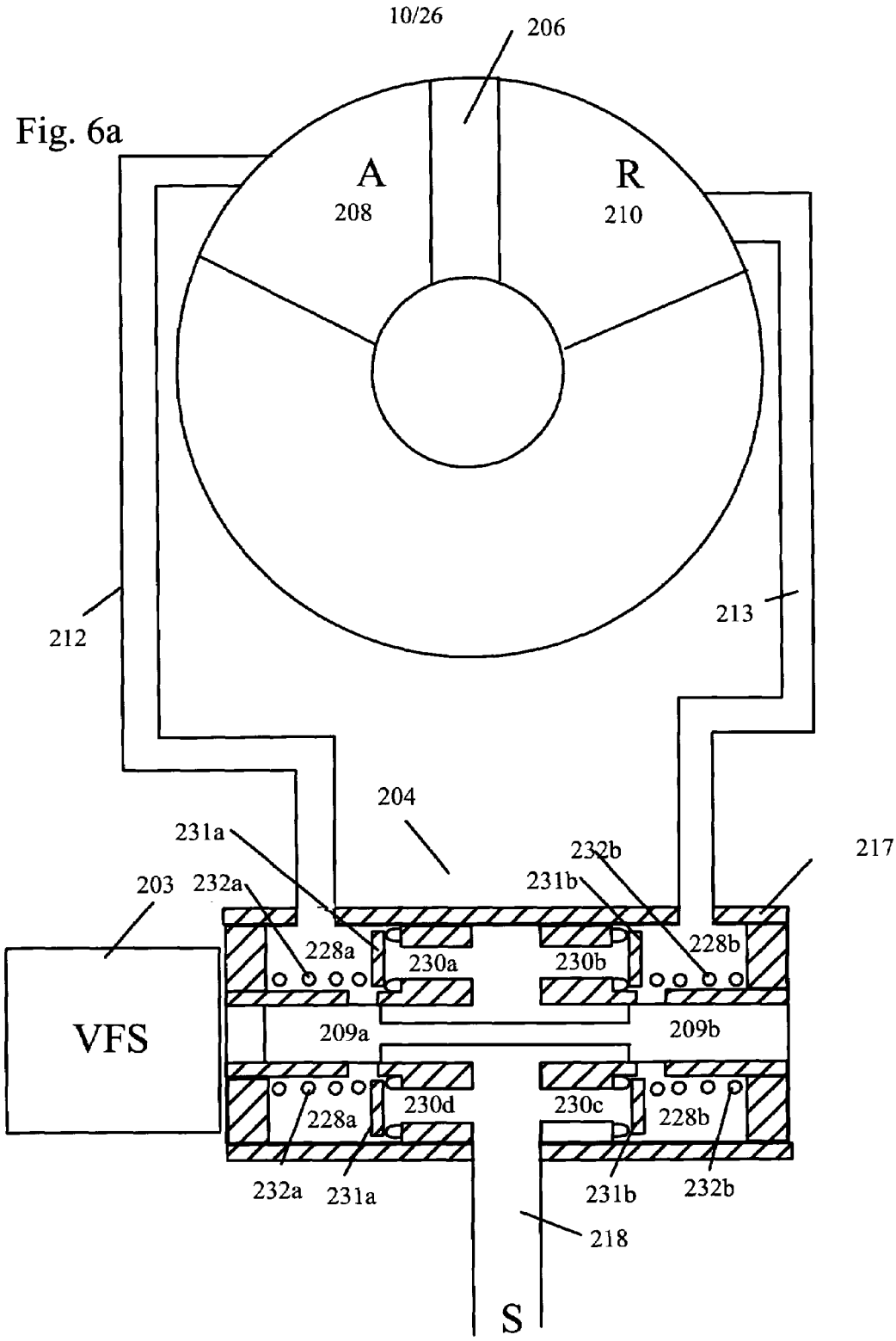
FIG. 6*a* shows a schematic of the spool with the check valve in the sleeve mounted to an oil pressure actuated phaser in the null position.

FIGS. 6*a* through 6*d* show the spool valve 204 mounted to an oil pressure actuated phaser. By adding spool valve 204 containing the check valves 228, the oil pressure actuated phaser (OPA) is converted to a cam torque actuated (CTA) phaser, gaining all of the advantages of CTA phaser, such as recirculation of oil, and better performance than present in the OPA system, since the performance is no longer related to pump capacity, as discussed earlier. FIG. 6*a* shows the spool 209 in the null position. Spool lands 209*a* and 209*b*, and check valves 228*a*, 228*b* block the entrance and exit of fluid from lines 212 and 213 leading to the advance and retard chambers 208, 210 respectively.

Figure 6B:
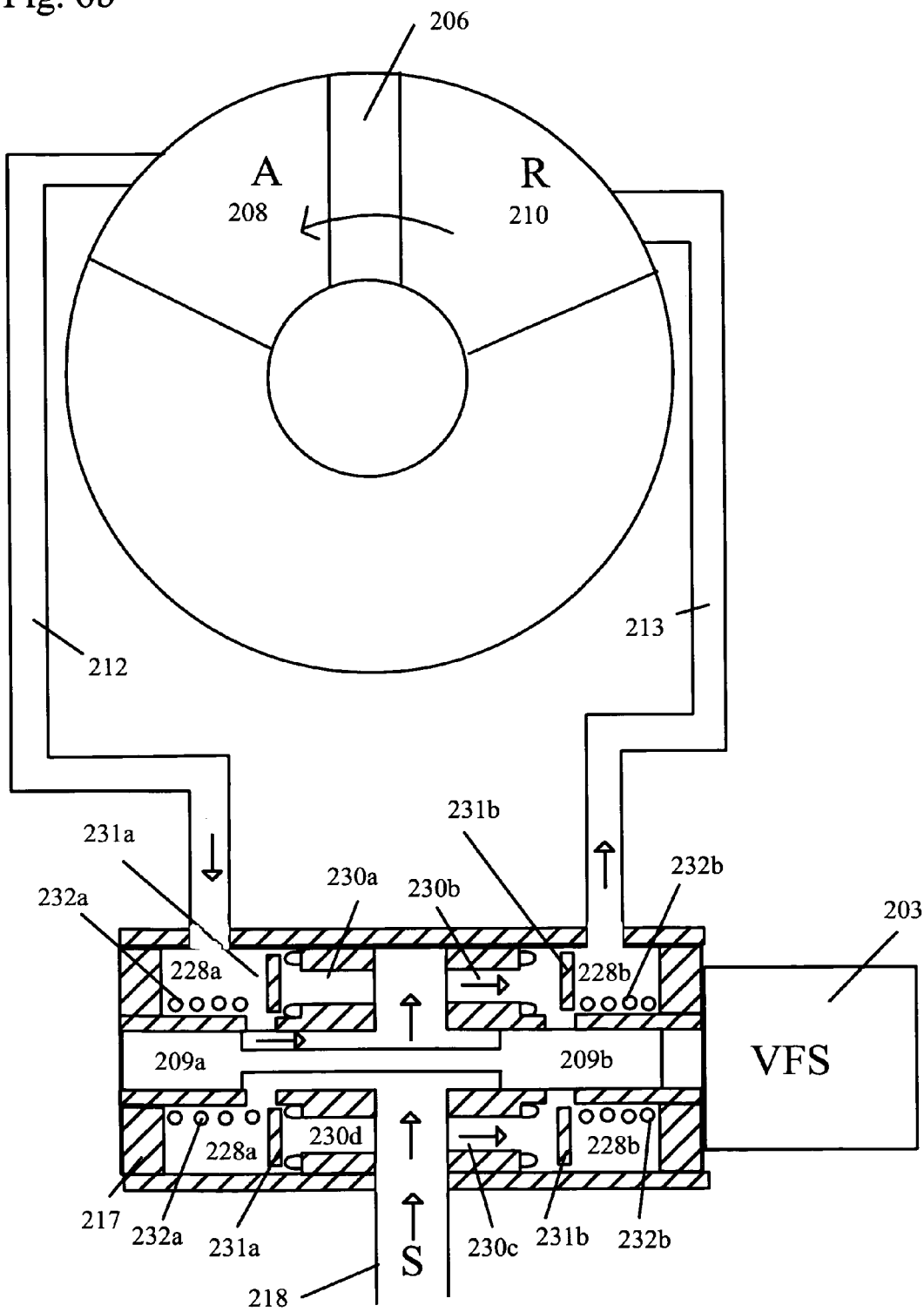
FIG. 6*b* shows a schematic of the spool with the check valve in the sleeve mounted to an oil pressure actuated phaser shifting to retard.

FIG. 6*b* shows the phaser shifting to the retard position. The VFS 203 moves the spool valve 204 to the left in the Figure, such that spool land 209*a* is no longer blocking the fluid flow to the center of the spool valve. The hydraulic fluid, which may be oil, enters the spool valve 204 through supply line 218. Fluid exits the advancing chamber 208 through line 212 into the advance check valve 228*a* of the cylindrical sleeve 217. Due to the position of the spool land 209*a*, fluid can exit to the center of the spool valve. From the center of the spool valve, fluid moves into passage 230*b*, 230*c* and pushes the disk 231*b*, against spring 232*b*, so that fluid can enter line 213 to the retard chamber 210. The fluid in the retard chamber moves the vane 206 to the left.

Figure 6C:
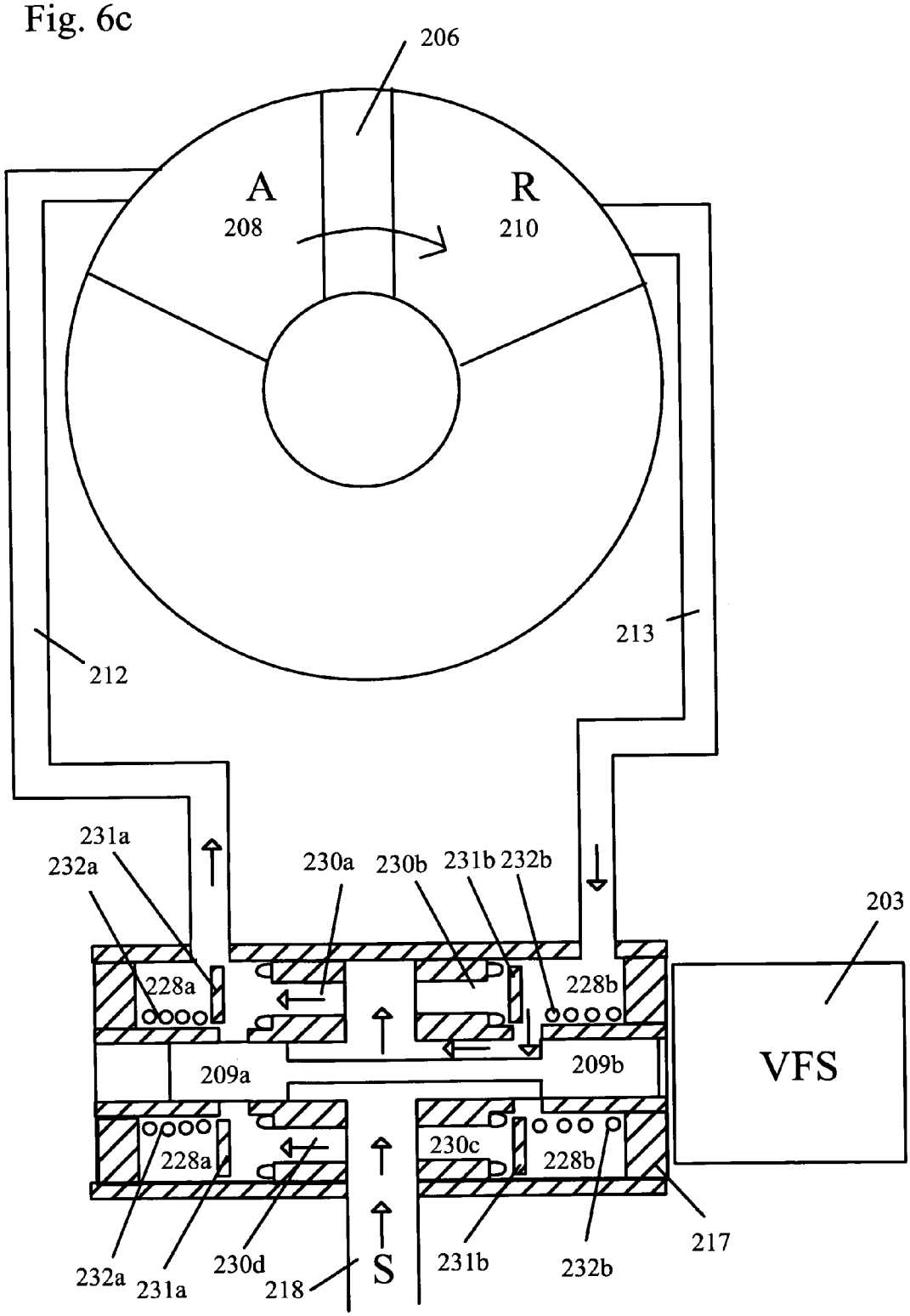
FIG. 6*c* shows a schematic of the spool with the check valve in the sleeve mounted to an oil pressure actuated phaser shifting to advance.

FIG. 6*c* shows the phaser shifting to the advance position. The VFS 203 moves the spool valve 204 to the right in the Figure, such that spool land 209*b* is no longer blocking the fluid flow to the center of the spool valve. The hydraulic fluid, which may be oil, enters the spool valve 204 through supply line 218. Fluid exits the retard chamber 210 through line 213 into retard check valve 228*b* of the cylindrical sleeve 217. Due to the position of the spool land 209*b*, fluid can exit to the center of the spool valve. From the center of the spool valve, fluid moves into passages 230*a*, 230*d* and pushes disk 231*a* against spring 232*a*, so that fluid can enter line 212 to the advance chamber 208. The fluid in the advance chamber 208 moves the vane 206 to the right.

Figure 6D:
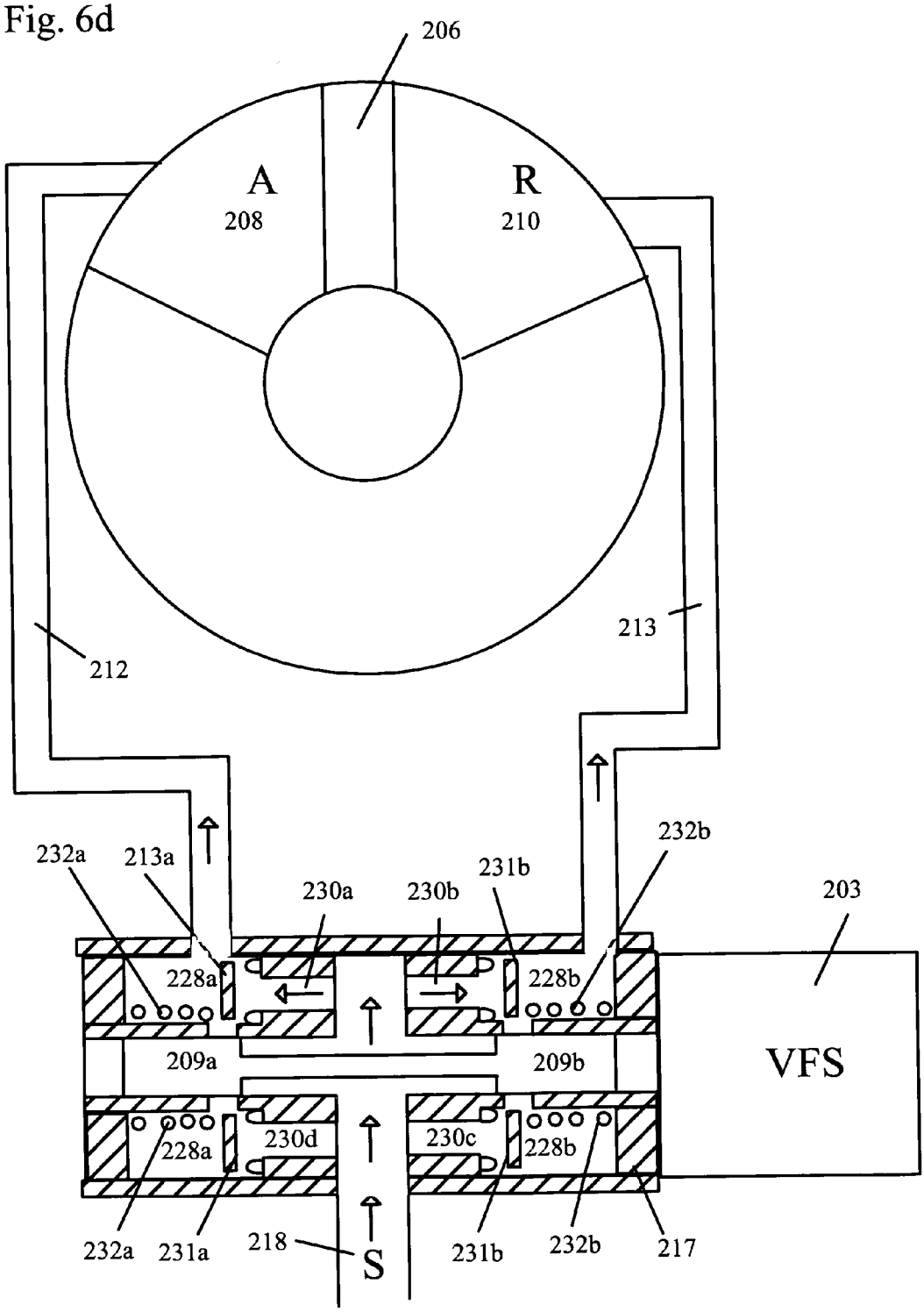
FIG. 6*d* shows a schematic of the spool with the check valve in the sleeve mounted to an oil pressure actuated phaser when oil needs to be supplied to a chamber (retard in this instance) due to leakage.

FIG. 6*d* shows replenishment of oil to the retard and advance chambers 210, 208 due to leakage. When source oil pressure at the center of the spool valve exceeds the pressure in the retard and advance lines 213, 212, the pressure is greater than the force of spring 232*a*, 232*b* and moves disks 231*a*, 231*b* so that fluid can enter lines 213, 212. The spool lands 209*a* and 209*b* block the outlet of the advance and retard check valves 228*a*, 228*b* closest to the supply line 218.

Some of the advantages of the spool valve of the first embodiment is that the spool valve can be remotely mounted to an already existing oil pressure actuated phaser, improving performance, decreasing the overall size and area the phaser takes up in the engine, and breaking the relationship between performance and supply pump capacity.

Figure 6E:
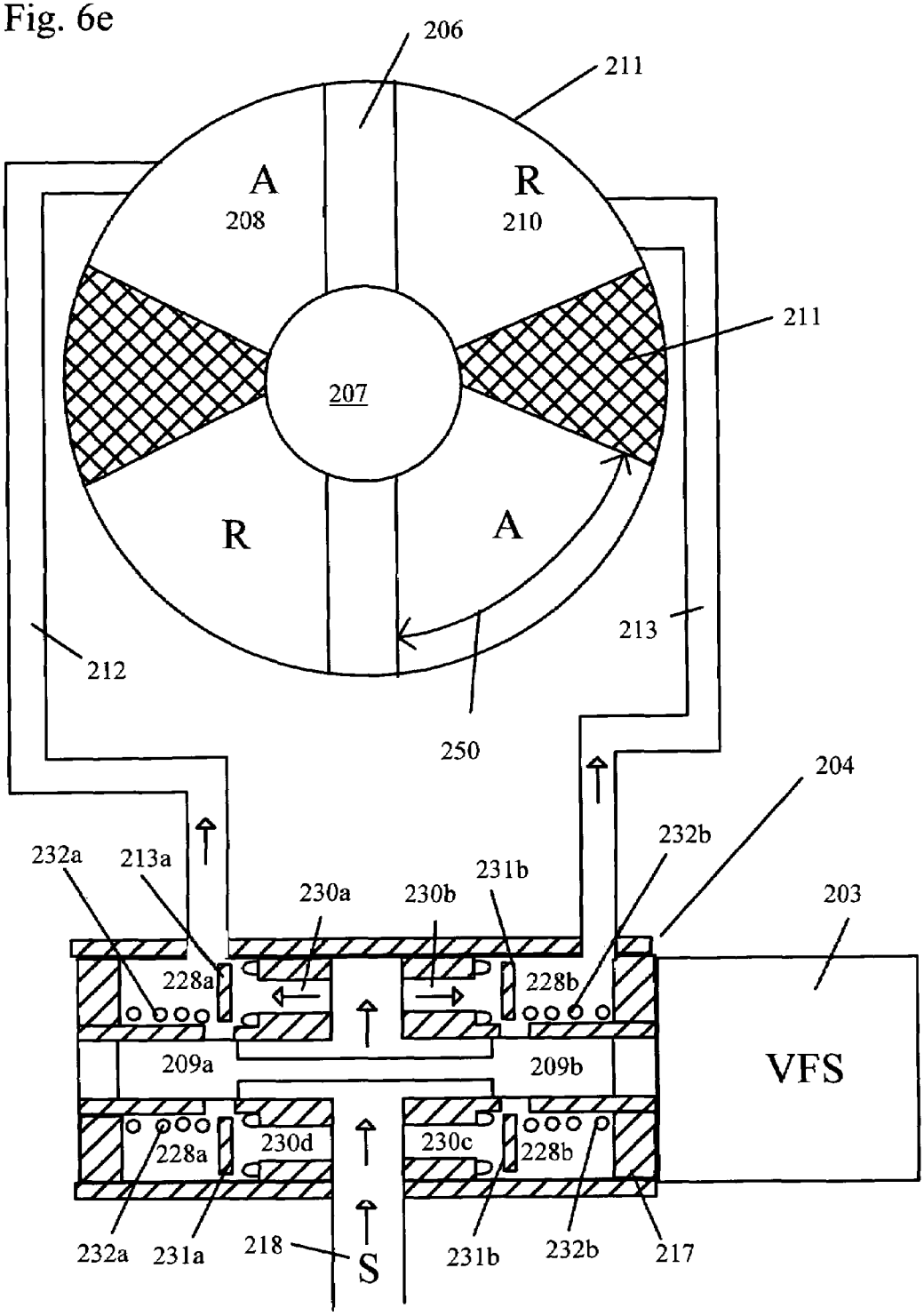
FIG. 6*e* shows a schematic of the spool with the check valve mounted in a sleeve mounted to a rotary actuator.

Additionally, the spool valve 204 may also by externally or internally connected to a stationary rotary actuator. FIG. 6*e* shows the spool valve 204 internally connected to a stationary rotary actuator. In the rotary actuator, the housing 211 does not have an outer circumference for accepting drive force and motion of the housing 211 is restricted. The restriction of the housing 211 ranges from not moving the housing 211 at all to the housing 211 having motion restricted to less than 360°. All movement, other than the twisting of the shaft is done by the rotor 207. The rotor 207 and the vane moves or swings through the distance as defined and limited by the housing 211. All of the cyclic load is on the rotor 207 and the rotor 207 accepts all of the drive force. The check valves may be located remotely from the sleeve.

Figure 7:
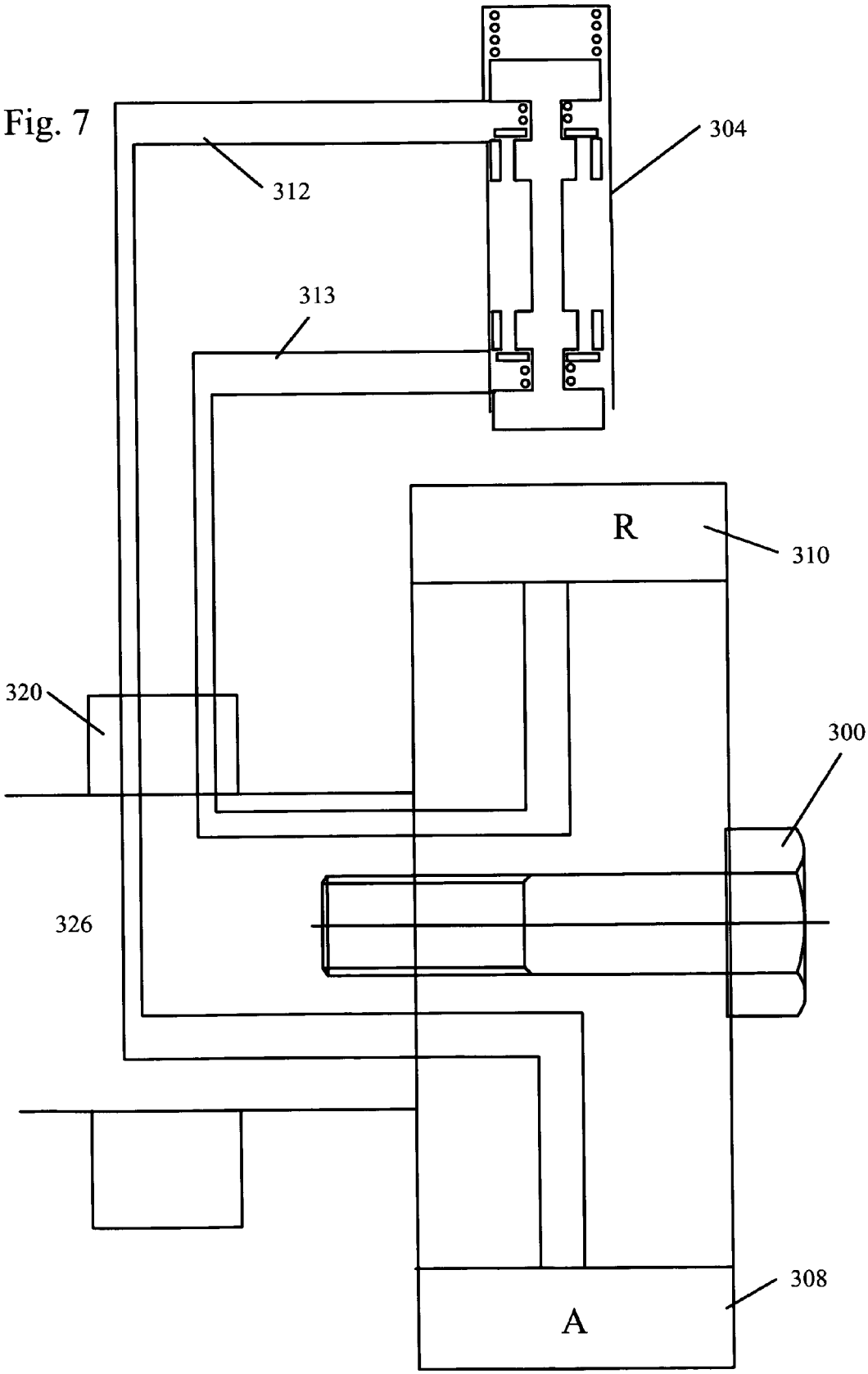
FIG. 7 shows an externally mounted spool valve with check valves in between the spool lands of a second embodiment.
Figure 8:
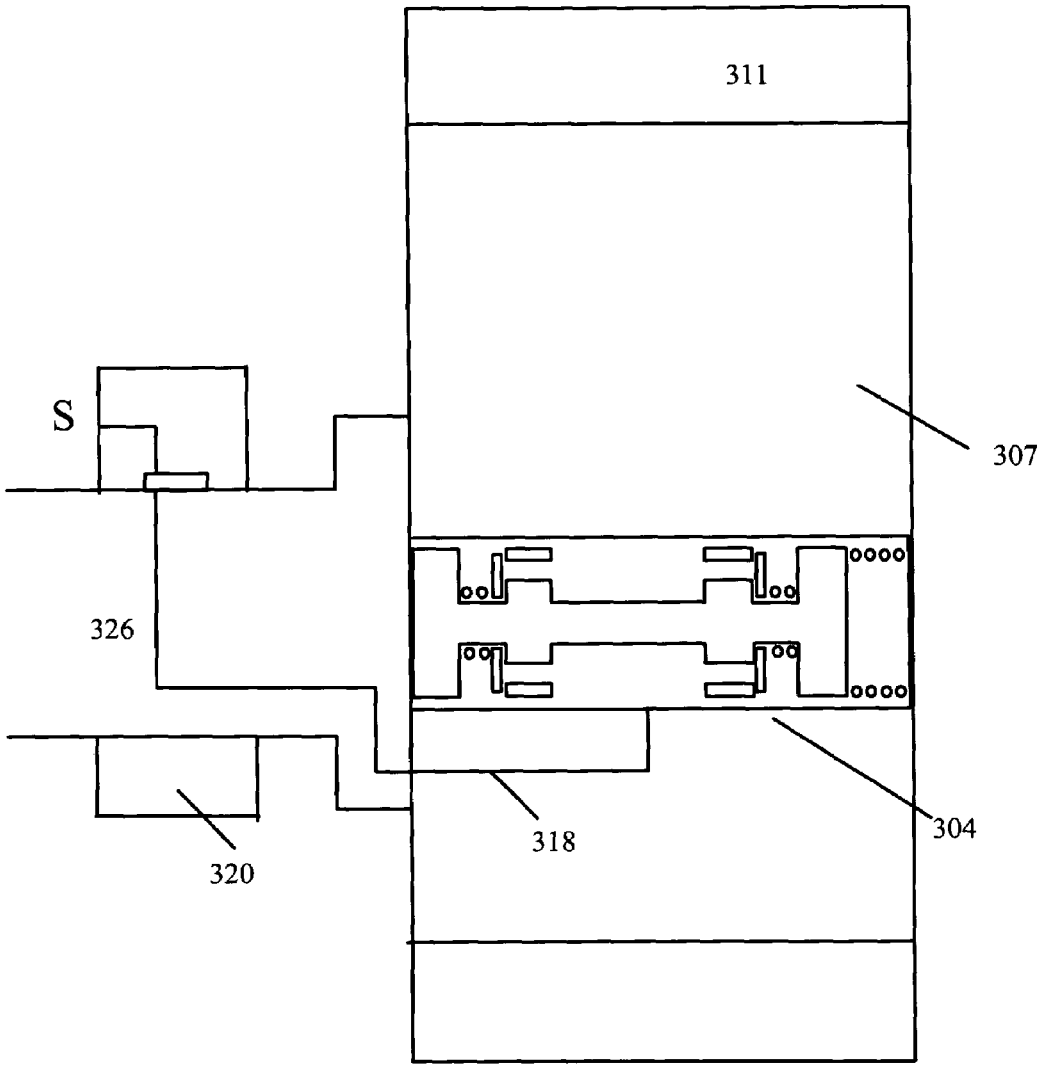
FIG. 8 shows an internally mounted spool valve with check valves in between the spool lands of a second embodiment.

FIGS. 7 through 11*c* show a spool valve 304 of a second embodiment. Spool valve 304 may be externally mounted or internally mounted as shown in FIGS. 7 and 8. FIGS. 7 and 8 do not show the supply line or the VFS. FIG. 7 shows the spool valve 304 mounted externally. Two lines 312, 313 run from the spool valve 304 through the cam bearing 320 of the camshaft 326, into the rotor 307 and housing 311 to the retard chamber 310 and the advance chamber 308. The lines 312, 313 are usually present on either side of a bolt 300, when the spool valve 304 is externally mounted. One of the advantages of externally mounting the spool valve is that the room required or the room that the phaser takes up in the engine is smaller and is shorter overall in length.

FIG. 8 shows the spool valve 304 mounted internally. The spool valve 304 is located in the center of the rotor 307. Supply provides hydraulic fluid to the spool valve 304 through line 318, which enters the phaser through the cam bearing 320 of the camshaft 326. Line 318 continues from the camshaft into the in the rotor 307 where the spool valve 304 is present. One of the advantages of internally mounting the spool valve 304 is the reduction of leakage of the phaser.

Figure 9:
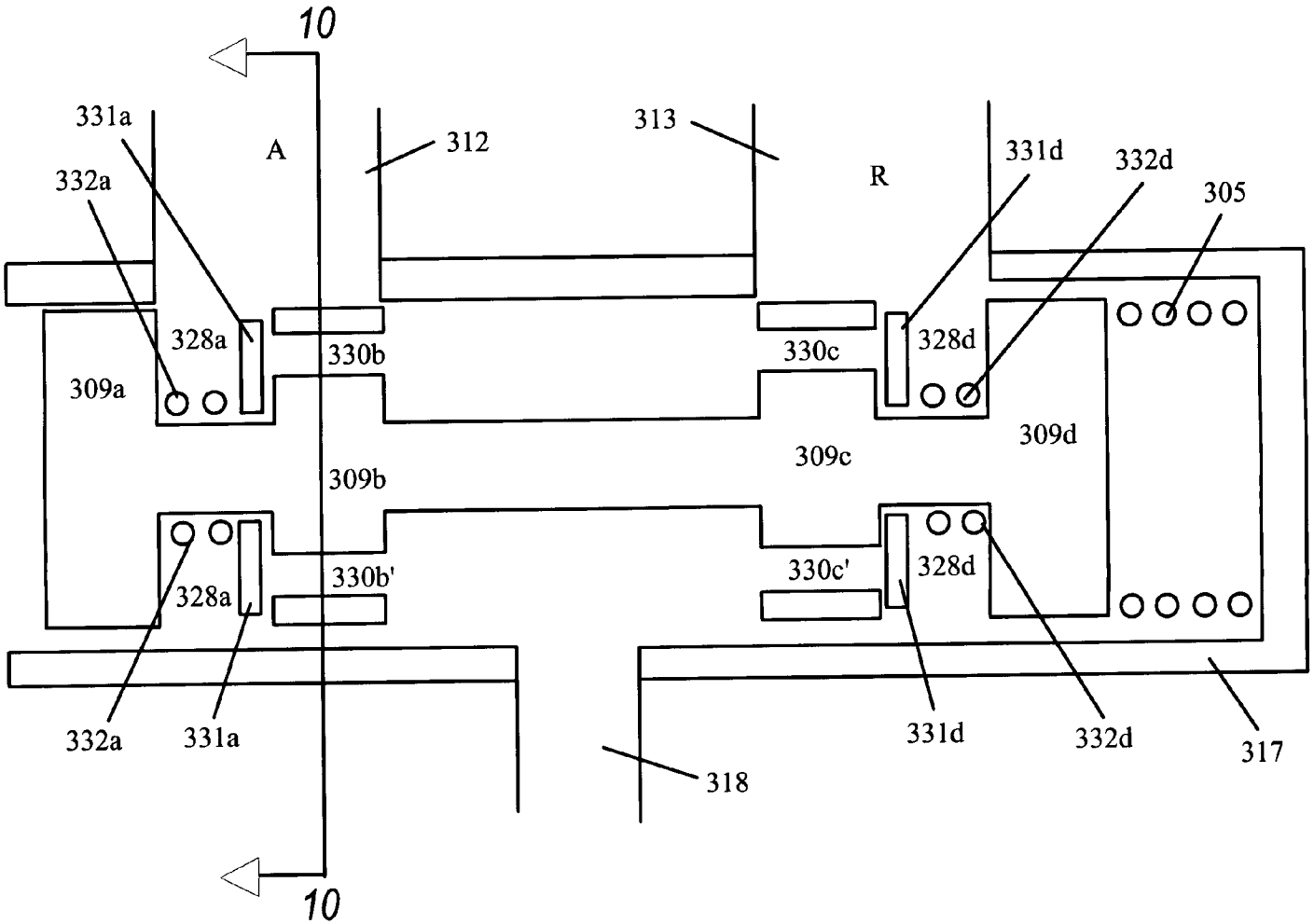
FIG. 9 shows a close-up of the spool valve.
Figure 10:
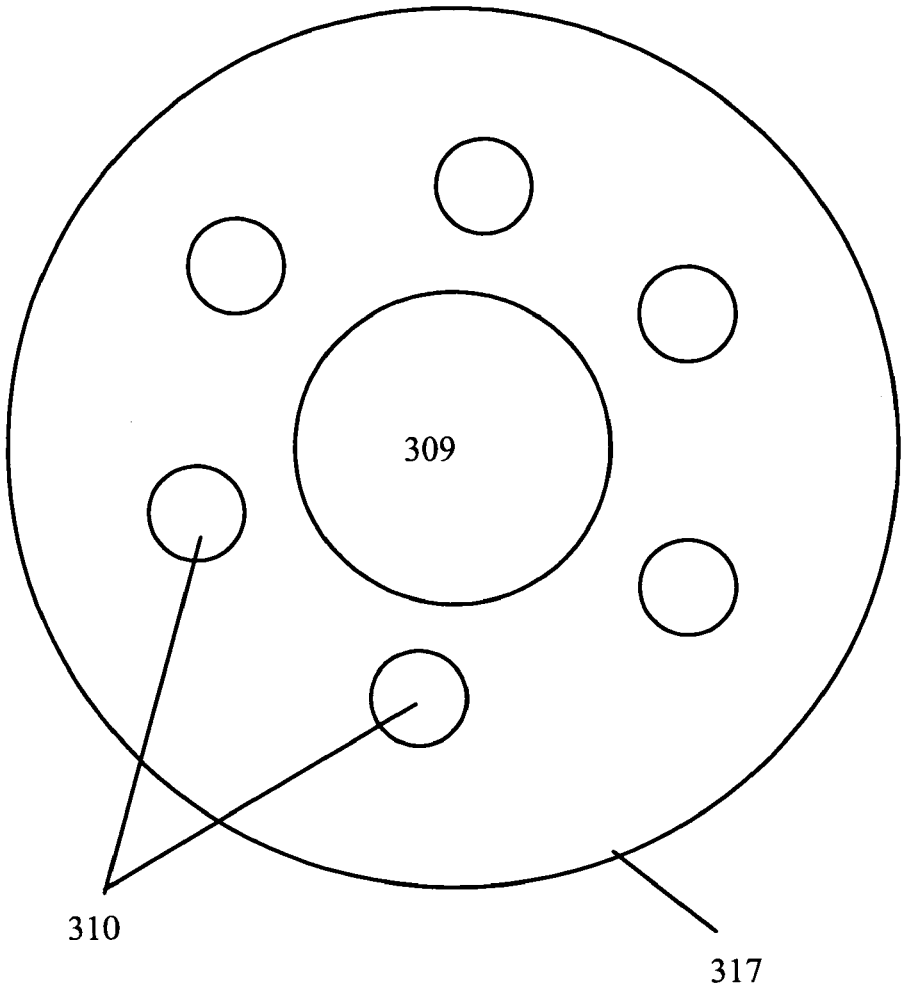
FIG. 10 shows a cross-section of the spool valve along line 10—10 in FIG. 9.

FIG. 9 shows a close-up of the spool valve 304. The spool 309 is comprised of lands 309*a*, 309*b*, 309*c*, and 309*d* which are separated by a central spindle and is surrounded by a cylindrical sleeve 317. Between the lands 309*a* and 309*b*, is check valve 328*a*. The check valve 328*a* is comprised of a disk 331*a*, a spring 332*a*, and multiple passages 330*b*, 330*b*' that are present within land 309*b*. Between lands 309*c* and 309*d* is check valves 328*d*. The check valve 328*d* is comprised of a disk 331*d*, a spring 332*d*, and multiple passages 330*c*, 330*c*' that are present within land 309*c*. Other types of check valves may be used, including band check valves, ball check valves, and cone-type. The spool valve 304 is actuated by a VFS 303 (not shown) and biased by a spring 305. FIG. 10 shows a cross-section of the spool valve along line 10—10 in FIG. 9. As seen in the cross-section, the placement of the multiple passages 330*b*, 330*b*', 330*c*, 330*c*' are shown in regards to the cylindrical sleeve. The number and placement of the multiple passages may vary.

Figure 11A:
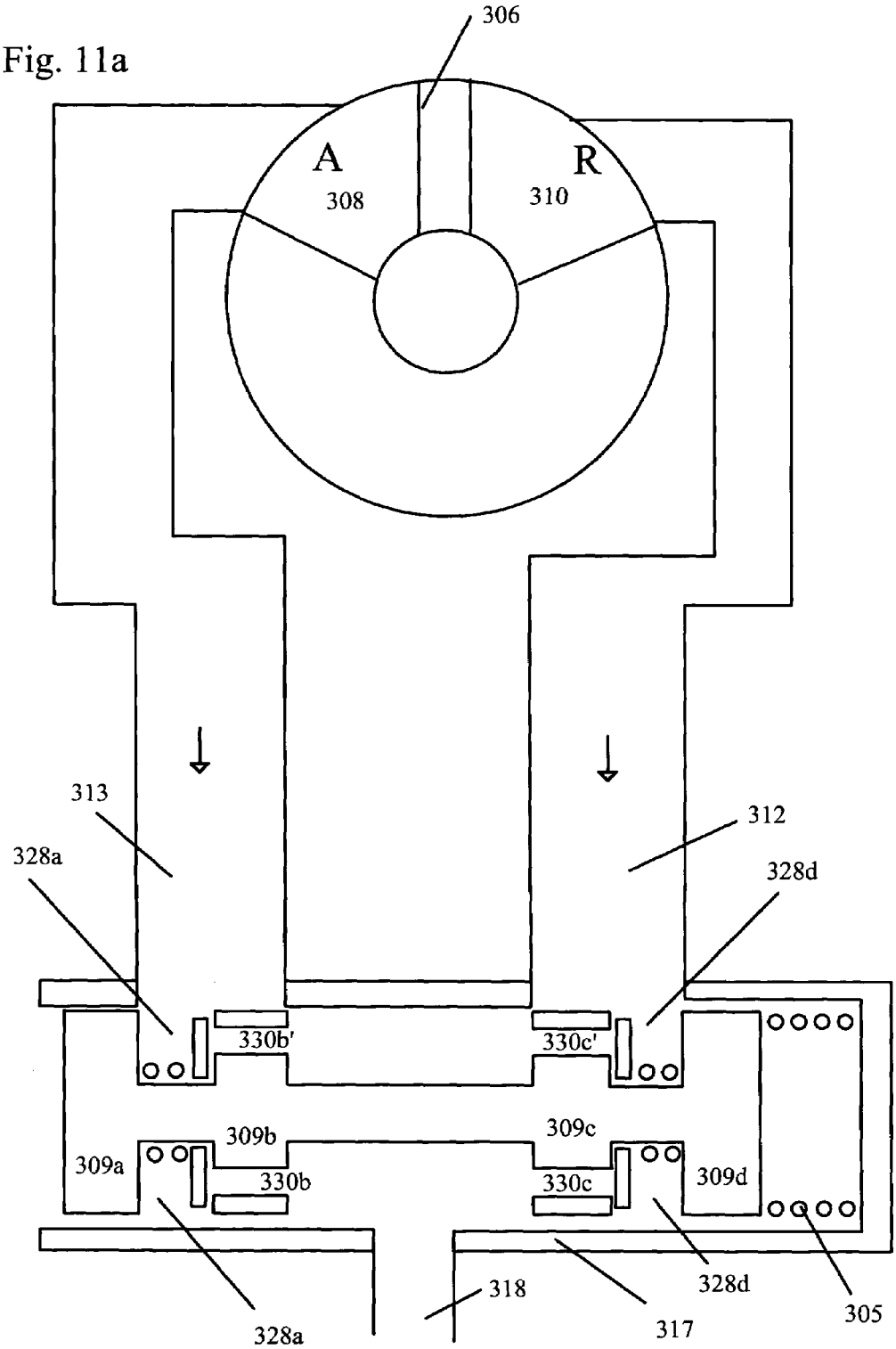
FIG. 11*a* shows a schematic of the spool valve of the second embodiment with a cam torque actuated phaser in the null position.
Figure 11B:
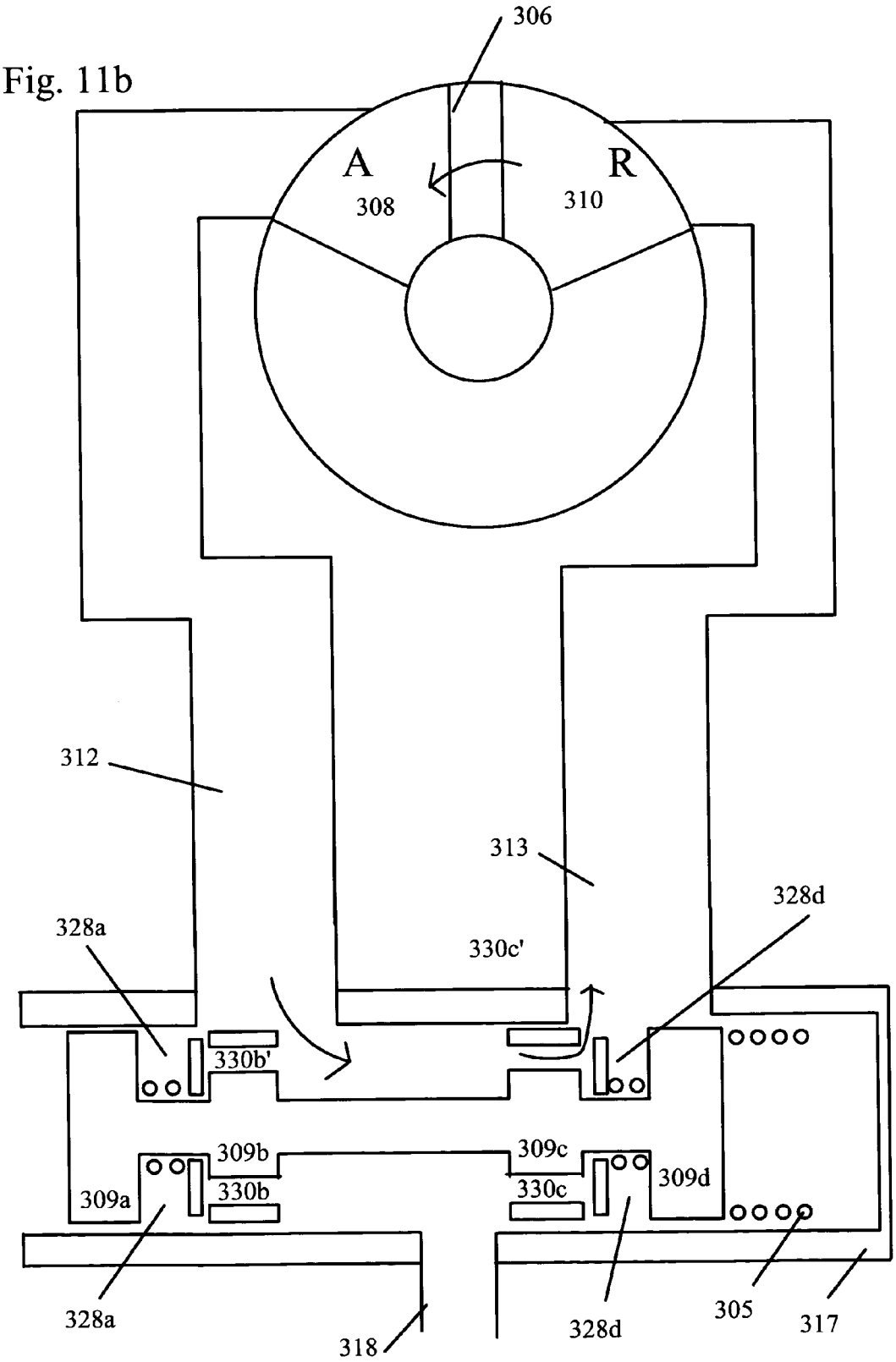
FIG. 11*b* shows a schematic of the spool valve of the second embodiment with a cam torque actuated phaser in the advanced position.
Figure 11C:
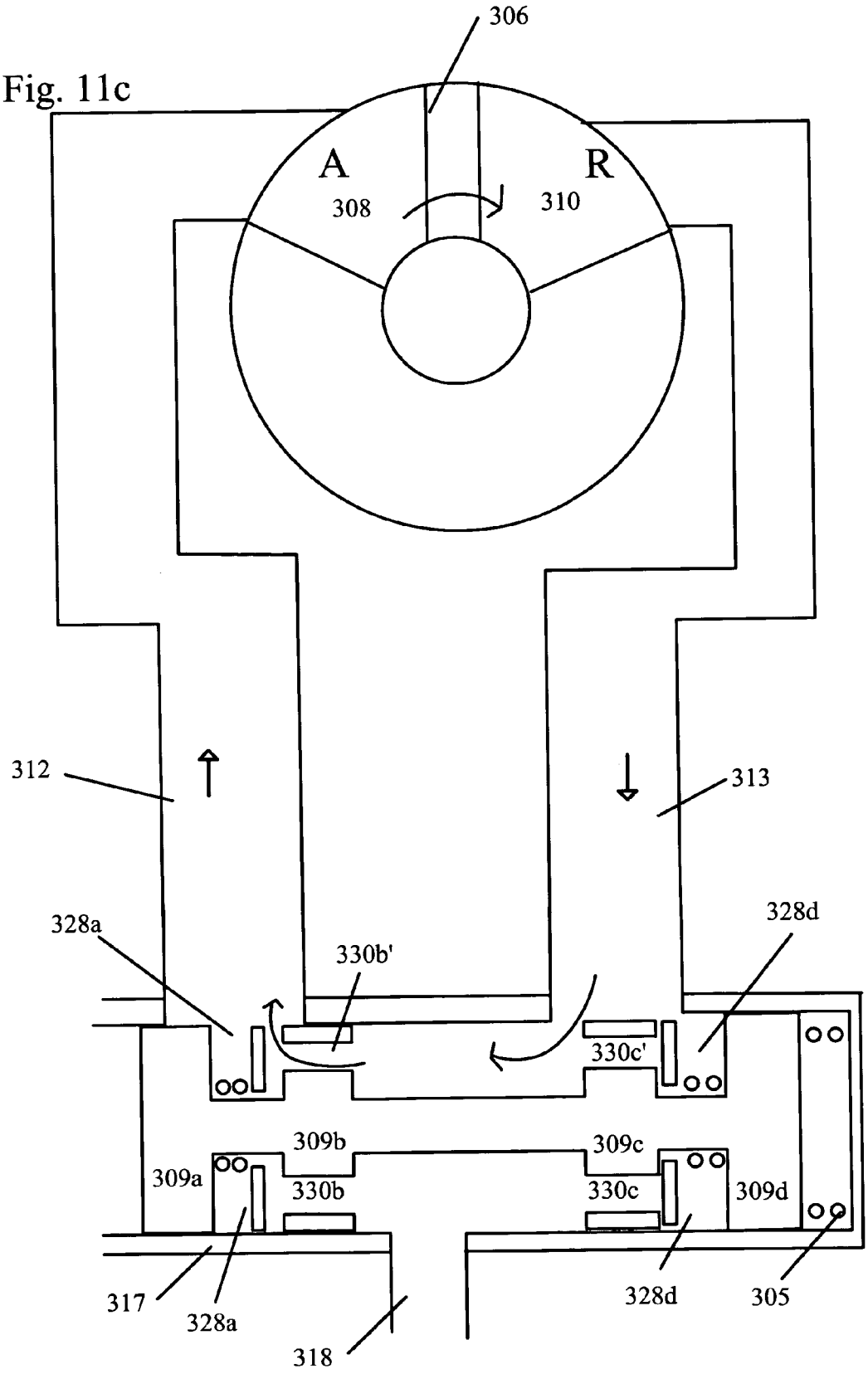
FIG. 11*c* shows a schematic of the spool valve of the second embodiment with a cam torque actuated phaser in the retard position.

FIGS. 11*a* through 11*c* show spool valve 304 mounted to a cam torque actuated phaser. FIG. 1*a* shows the spool valve in the null position. In this position, the edge of land 309*a* and land 309*b* and check valve 328*a* between the edges of lands 309*a* and 309*b* block inlet line 313, and land 309*c* and the edge of land 309*d* and check valve 328*d* between the edges of lands 309*c* and 309*d* blocks inlet line 312. Makeup fluid enters inlet lines 312, 313 through passages 330*b*', and 330*c*' respectively, moving disk 331*a* or 331*d* to allow for refilling of the phaser due to leakage.

FIG. 11*b* shows the spool valve 304 in the retard position. The VFS 303 (not shown) moves the spool to the left since the force of the spring 305 is greater than the force exerted by the VFS 303 (not shown) on the spool 309. The spool is moved until land 309*d* blocks part of inlet line 313 and the check valve 328*d* is open to line 313 and spool land 309*b* is opening part of inlet line 312. Fluid in the advance chamber 308 exits through inlet line 312 into the center of the spool valve. From the center of the spool valve, fluid moves into passage 330*c*' and has enough pressure to move disk 331*d* of check valve 328*d* against the force of spring 332*d*', allowing the fluid to enter line 313 to the retard chamber.

FIG. 11*c* shows the spool valve in the advance position. The VFS 303 (not shown) moves the spool to the right since the force of the VFS is greater than the force of the spring 305 on the spool 309. The spool is moved until land 309*a* blocks part of inlet line 312 and check valve 328*a*' is open to line 312 and spool land 309*c* is opening part of inlet line 313. Fluid from the retard chamber 310 exits through inlet line 313 into the center of the spool valve, From the center of the spool valve, fluid moves into passage 330*b*' and has enough pressure to move disk 331*a* of check valve 328*a* against the force of spring 332*a*, allowing fluid to enter line 312 to the advance chamber.

Additionally, the spool valve 304 may also by externally or internally connected to a stationary rotary actuator similar to FIG. 6*e*. In the rotary actuator, the housing does not have an outer circumference for accepting drive force and motion of the housing is restricted. The restriction of the housing ranges from not moving the housing at all to the housing having motion restricted to less than 360°. All movement, other than the twisting of the shaft is done by the rotor. The rotor and the vane moves or swings through the distance as defined and limited by the housing. All of the cyclic load is on the rotor and the rotor accepts all of the drive force. The check valves may be located remotely from the spool.

Figure 12:
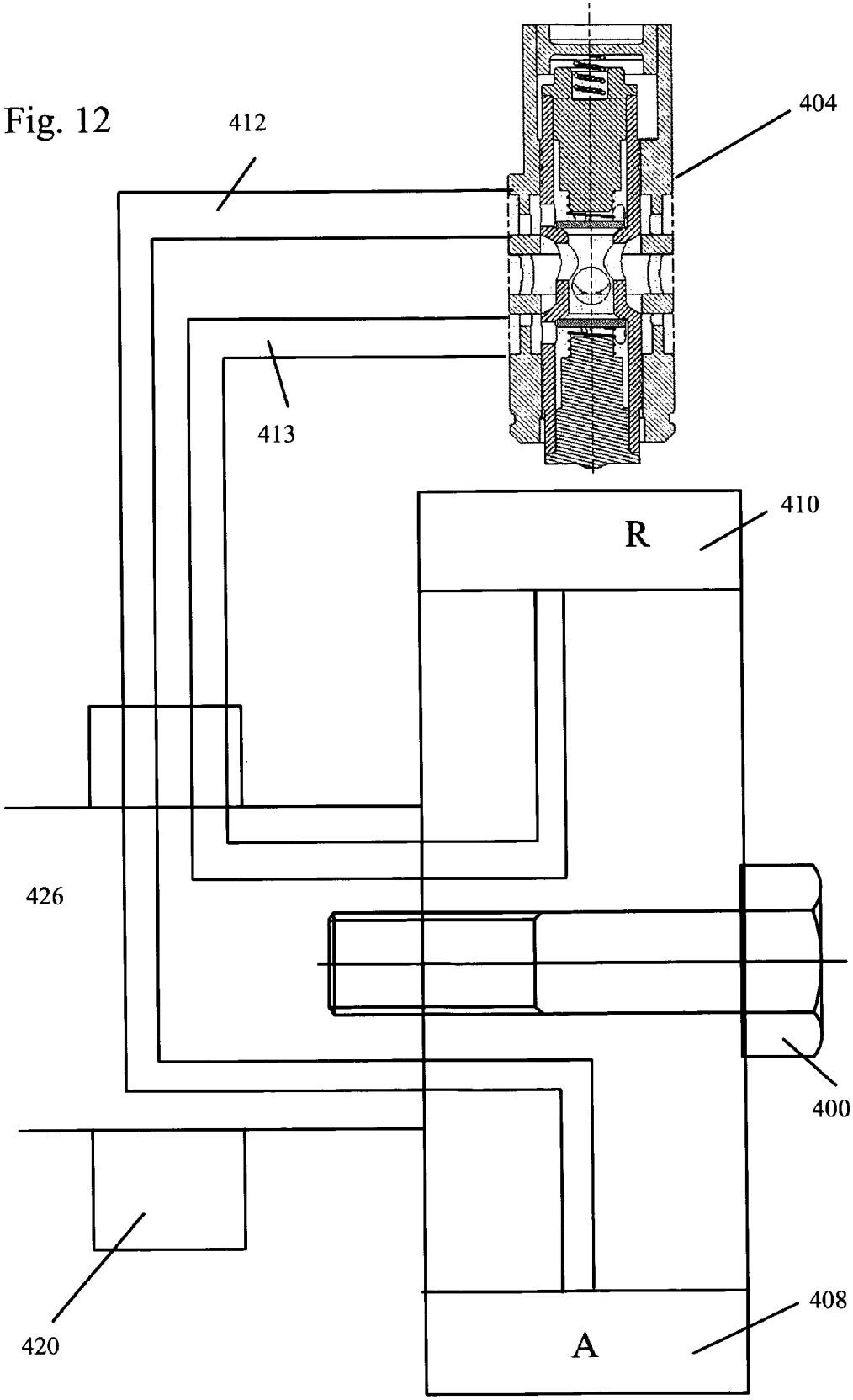
FIG. 12 shows an externally mounted spool valve with check valves in the spool body of a third embodiment.
Figure 13:
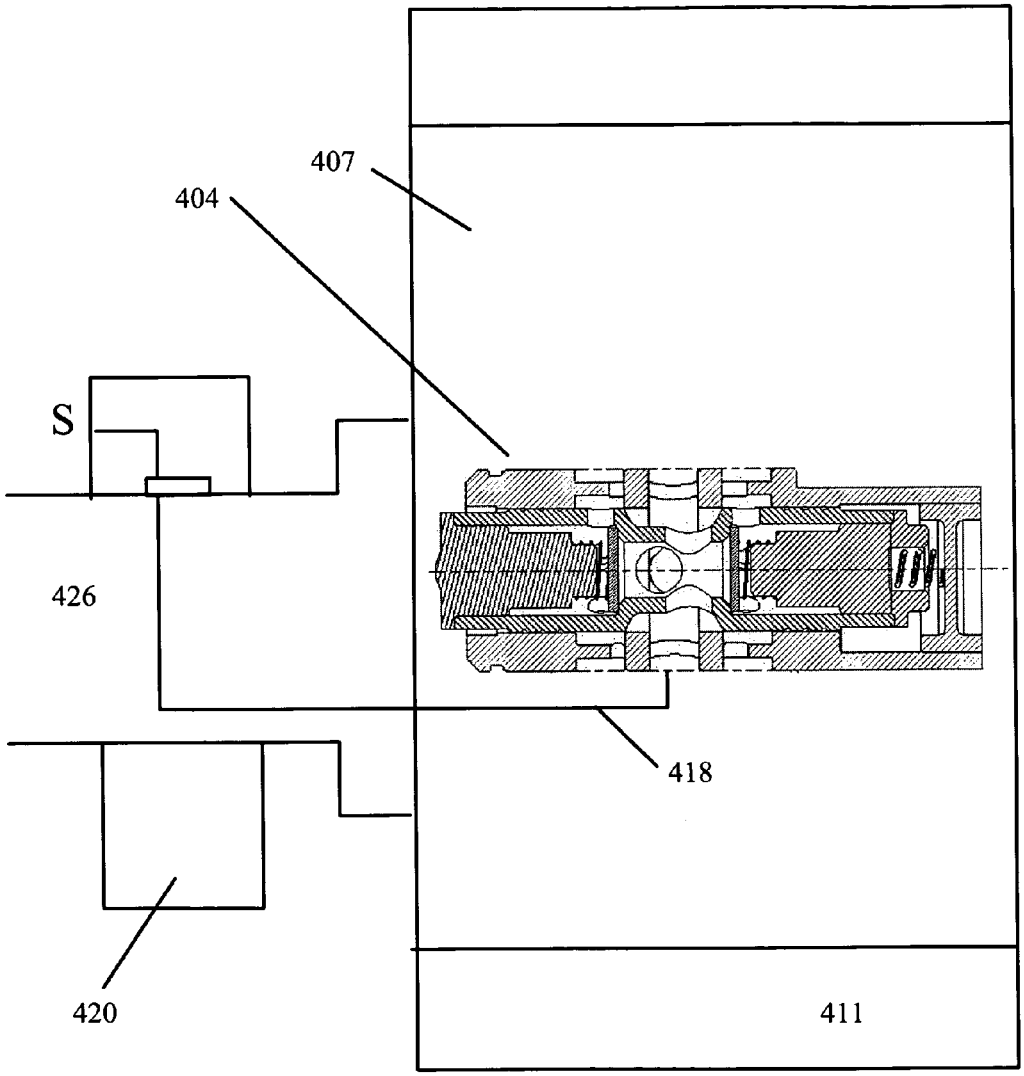
FIG. 13 shows an internally mounted spool valve with check valves in the spool body of a third embodiment.

FIGS. 12 through 15*c* show a spool valve 404 of a third embodiment. Spool valve 404 may be externally mounted or internally mounted as shown in FIGS. 12 and 13. FIGS. 12 and 13 do not show the supply line or the VFS. FIG. 12 shows the spool valve 404 externally mounted. Two lines 412, 413 run from the spool valve 404 through the cam bearing 420 of the camshaft 426, into the rotor 407 and housing 411 to the retard chamber 410 and the advance chamber 408. The lines 412, 413 are usually present on either side of a bolt 400 when the spool valve 404 is externally mounted. One of the advantages of externally mounting the spool valve is that the room required or the room that the phaser takes up in the engine is smaller and is shorter overall in length.

FIG. 13 shows the spool valve 404 mounted internally. The spool valve 404 is located in the center of the rotor 407. Supply provides hydraulic fluid to the spool valve 404 through line 418, which enter the phaser through the cam bearing 420 of the camshaft 426. From the camshaft 426, line 418 continues into the in the rotor 407 where the spool valve 404 is present. One of the advantages of internally mounting the spool valve 404 is the reduction of leakage of the phaser.

Figure 14:
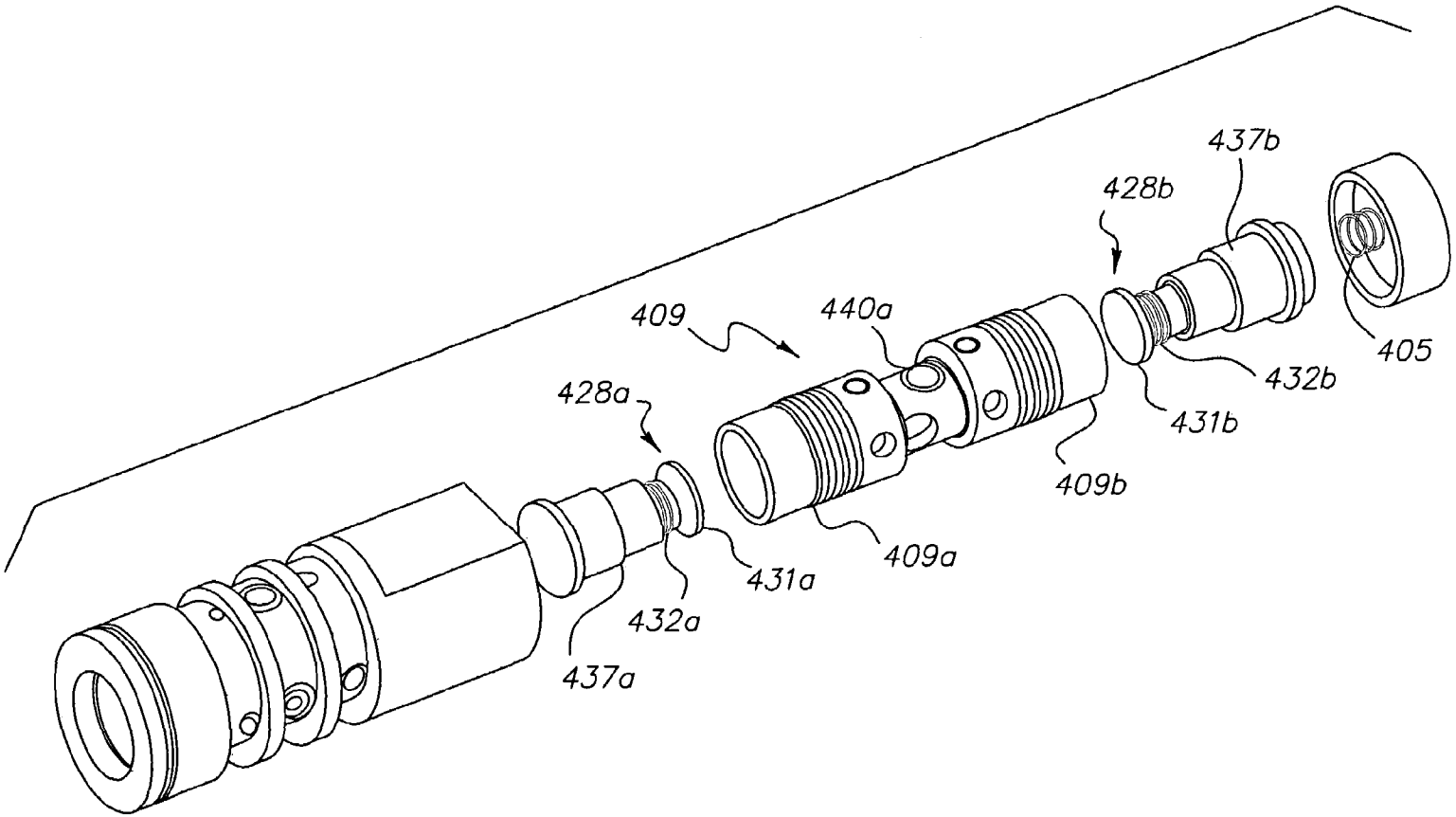
FIG. 14 shows an exploded view of the spool valve of the third embodiment.

FIG. 14 shows an exploded view of the spool. The spool 409 has two lands 409*a* and 409*b* separated by a central spindle. Within each of the lands 409*a* and 409*b* are plugs 437*a*, 437*b* that house check valves 428*a* and 428*b*. Each check valve is made up of a disk 431*a*, 431*b* and a spring 432*a*, 432*b*. Other types of check valves may be used, including band check valves, ball check valves, and cone-type. The VFS 403, not shown, actuates the spool valve 404 and biased by a spring 405.

Figure 15A:
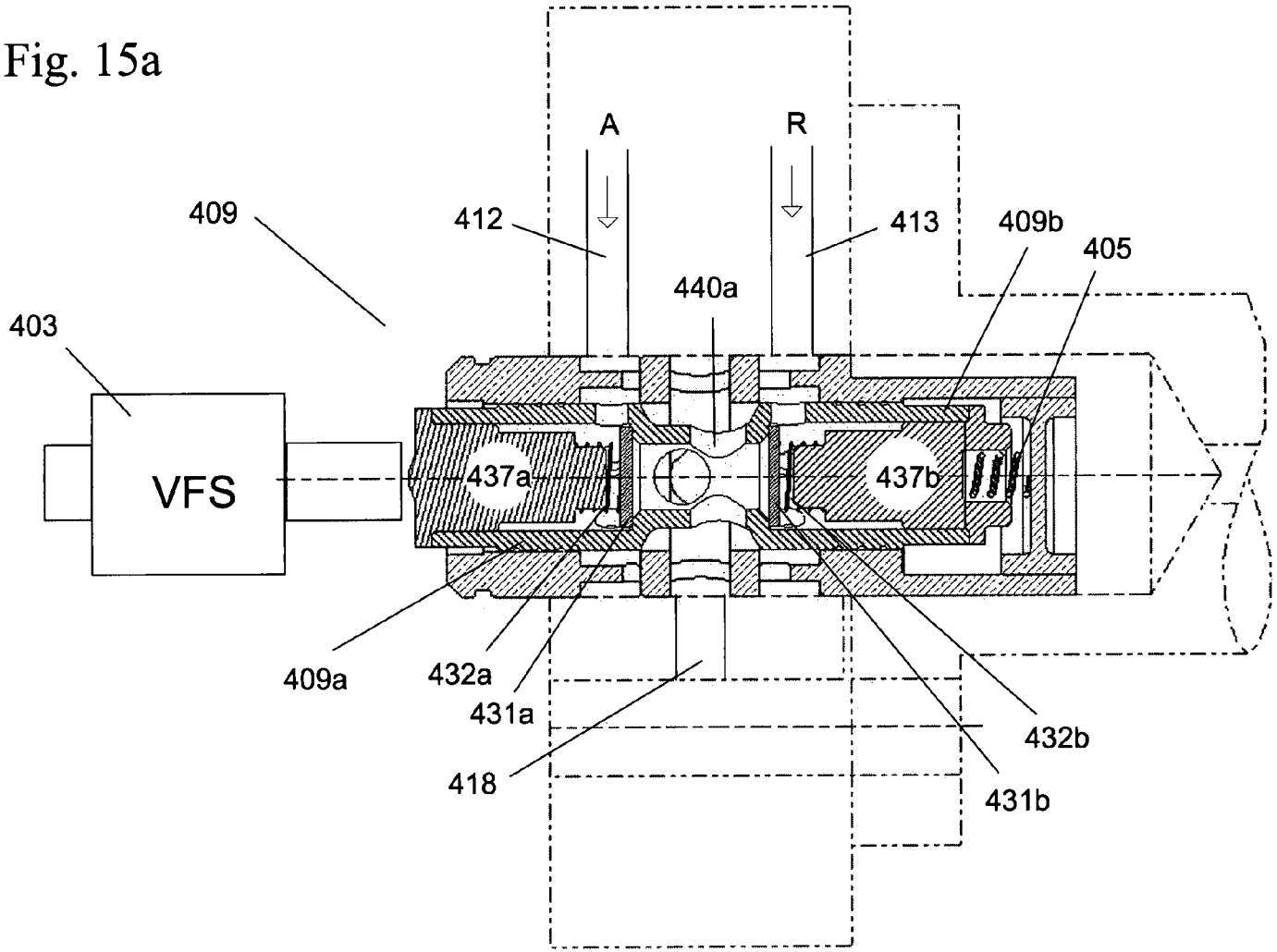
FIG. 15*a* shows a schematic of the spool valve of the third embodiment with a cam torque actuated phaser in the null position.
Figure 15B:
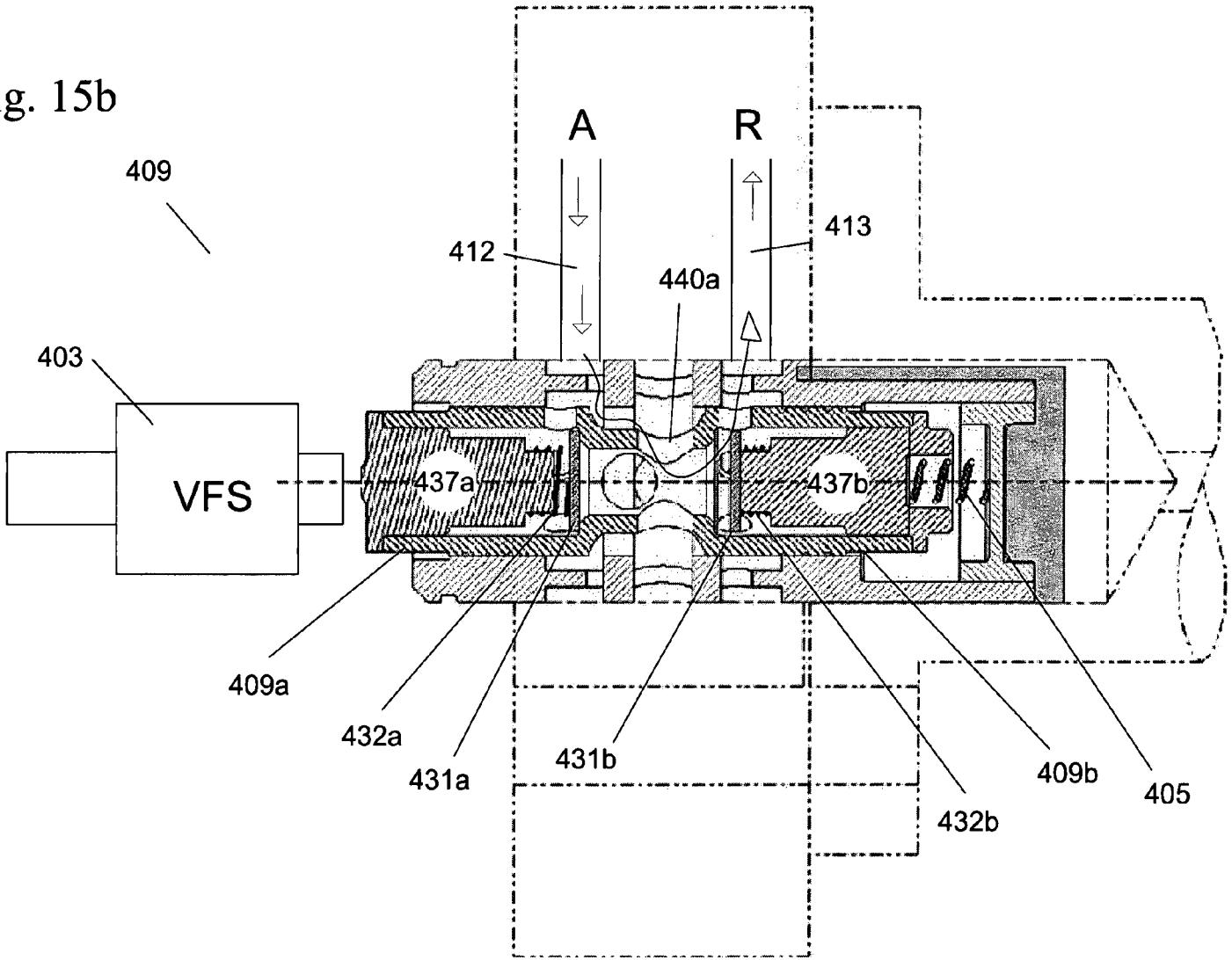
FIG. 15*b* shows a schematic of the spool valve of the third embodiment with a cam torque actuated phaser in the retard position.
Figure 15C:
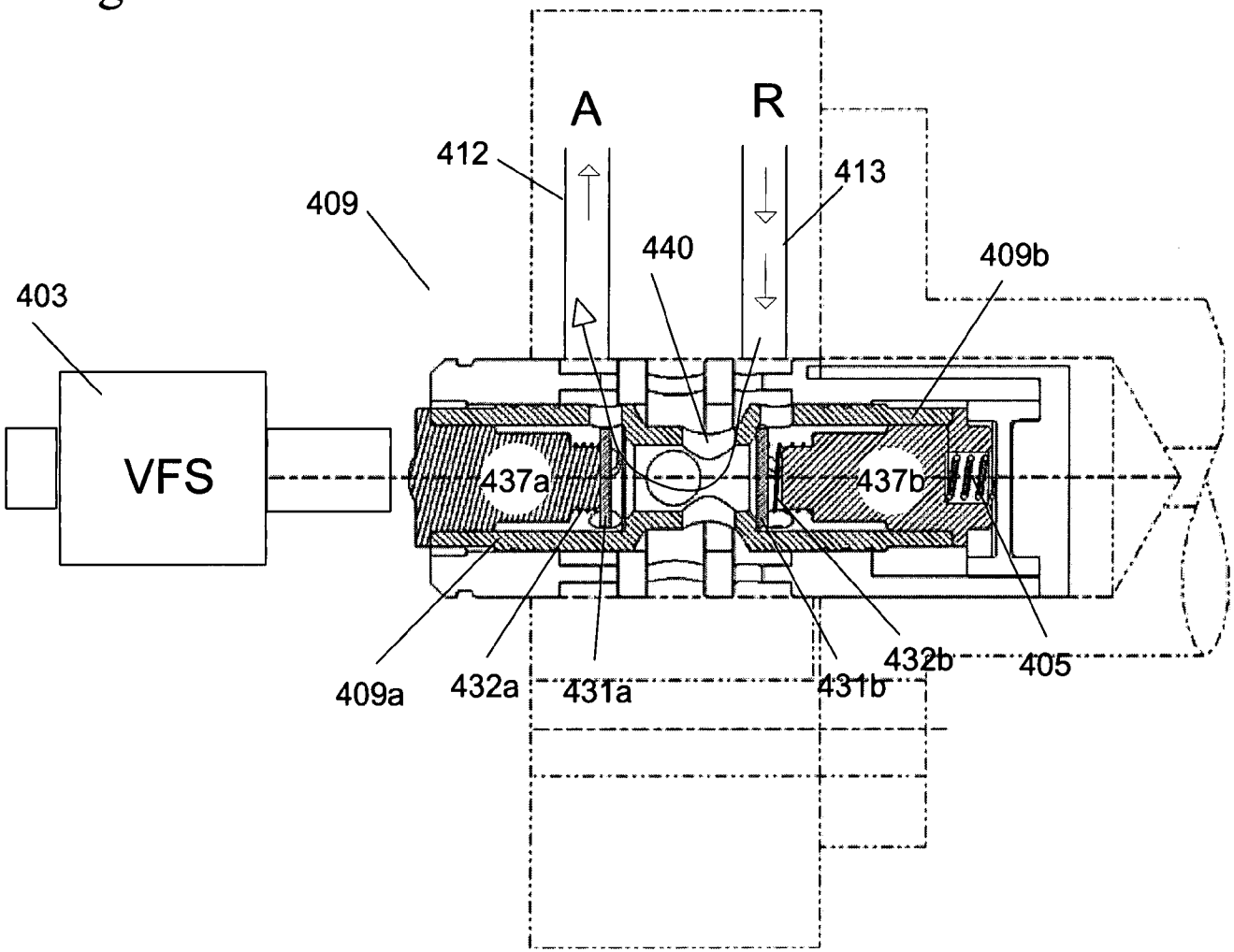
FIG. 15*c* shows a schematic of the spool valve of the third embodiment with a cam torque actuated phaser in the advanced position.

FIGS. 15*a* through 15*c* shows spool valve 404 mounted to a cam torque actuated phaser (not shown). FIG. 15*a* shows the spool valve 404 in the null position. In this position, disks 431*a*, 431*b* of check valves 428*a*, 428*b* block the exit of the fluid from inlet lines 412, 413 into the middle of the spool 409. A small amount of fluid is supplied from line 418 and allowed to refill the advance and retard chambers through lines 412, 413 due to leakage.

FIG. 15*b* shows the spool valve in the retard position. The VFS 403 moves the spool valve to the left since the force of the spring is greater than the force exerted by the VFS 403 on the spool 409. When the spool is in this position, fluid from the advance chamber (not shown) exits to the spool valve through line 412. Fluid passes through central hole 440*a* into the spool 409 moving the disk 431*b* against spring 432*b* of check valve 428*b*, allowing fluid to enter line 413 to the retard chamber (not shown).

FIG. 15*c* shows the spool in the advance position. The VFS 403 moves the spool valve to the right since the force of VFS on the spool is greater than the force of spring 405 on the opposing end of the spool. When the spool is in this position, fluid from the retard chamber (not shown) exits to the spool valve through line 413. Fluid passes through central hole 440*a* into the spool 409, moving the disk 431*a* against spring 432*a* of check valve 428*a*, allowing fluid to enter line 412 to the advance chamber (not shown).

Additionally, the spool valve 404 may also by externally or internally connected to a stationary rotary actuator similar to FIG. 6*e*. In the rotary actuator, the housing does not have an outer circumference for accepting drive force and motion of the housing is restricted. The restriction of the housing ranges from not moving the housing at all to the housing having motion restricted to less than 360°. All movement, other than the twisting of the camshaft is done by the rotor. The rotor and the vane moves or swings through the distance as defined and limited by the housing. All of the cyclic load is on the rotor and the rotor accepts all of the drive force.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine having at least one camshaft comprising:

a housing having an outer circumference for accepting drive force;

a rotor for connection to a camshaft coaxially located within the housing, the housing and the rotor defining at least one vane separating a chamber in the housing into an advance chamber and a retard chamber, the vane being capable of rotation to shift the relative angular position of the housing and the rotor;

a spool valve comprising a spool having at least two lands separated by a central spindle, slidably mounted within a sleeve received by a bore, and a plurality of check valves; and a passage from the advance chamber to a port in the spool valve and a passage from the retard chamber to a port in the spool valve, such that when the spool is in the first position, fluid from the advance chamber flows through the passage and the port to the bore surrounding the central spindle of the spool valve and through a first check valve within the spool valve and port to the passage to the retard chamber and when the spool is in the second position, fluid from the retard chamber flows through the passage and the port to the bore surrounding the central spindle of the spool valve and through a second check valve within the spool valve and port to the passage to the advance chamber;

wherein when the spool is in the third position, the passage from the advance chamber to the port in the spool is blocked by the second check valve within the spool valve and the passage from the retard chamber to the port in the spool valve is blocked by the first check valve within the spool valve.

2. The variable cam timing phaser of claim 1, wherein the plurality of check valves are located between the at least two lands separated by a central spindle of the spool.

3. The variable cam timing phaser of claim 1, wherein the plurality of check valves are located within the sleeve of the rotor.

4. The variable cam timing phaser of claim 1, wherein the bore and the sleeve are remote from the rotor.

5. The variable cam timing phaser of claim 1, wherein the plurality of check valves are located within the at least two lands of the spool.

6. The variable cam timing phaser of claim 5, wherein the at least two lands of the spool further comprise plugs.

7. The variable cam timing phaser of claim 1, wherein the plurality of check valves are comprised of a spring and a disc.

8. The variable cam timing phaser of claim 1, wherein the plurality of check valves are comprised of a spring and a ball.

9. The variable cam timing phaser of claim 1, wherein the plurality of check valves are comprised of a steel band.

10. A spool valve for a variable cam timing phaser for an internal combustion engine having at least one camshaft comprising: a housing having an outer circumference for accepting drive force and a rotor for connection to a camshaft coaxially located within the housing, the housing and the rotor defining at least one vane separating a chamber in the housing into an advance chamber and a retard chamber, the vane being capable of rotation to shift the relative angular position of the housing and the rotor; the spool valve comprising:

a spool having at least two lands separated by a central spindle, slidably mounted within a sleeve received by a bore, and a plurality of check valves; and a passage from the advance chamber to a port in the spool valve and a passage from the retard chamber to a port in the spool valve, such that when the spool is in the first position, fluid from the advance chamber flows through the passage and the port to the bore surrounding the central spindle of the spool valve and through a first check valve within the spool valve and port to the passage to the retard chamber and when the spool is in the second position, fluid from the retard chamber flows through the passage and the port to the bore surrounding the central spindle of the spool valve and through a second check valve within the spool valve and port to the passage to the advance chamber;

wherein when the spool is in the third position, the passage from the advance chamber to the port in the spool is blocked by the second check valve within the spool valve and the passage from the retard chamber to the port in the spool valve is blocked by the first check valve within the spool valve.

11. The spool valve of claim 10, wherein the plurality of check valves are located between the at least two lands separated by a central spindle of the spool.

12. The spool valve of claim 10, wherein the plurality of check valves are located within the sleeve of the rotor.

13. The spool valve of claim 10, wherein the plurality of check valves are located within the at least two lands of the spool.

14. The spool valve of claim 13, wherein the at least two lands of the spool further comprise plugs.

15. The spool valve of claim 10, wherein the bore and the sleeve are remote from the rotor.

16. The spool valve of claim 10, wherein the plurality of check valves are comprised of a spring and a disc.

17. The spool valve of claim 10, wherein the plurality of check valves are comprised of a spring and a ball.

18. The spool valve of claim 10, wherein the plurality of check valves are comprised of an elastic band.

19. A rotary actuator for an internal combustion engine having at least one camshaft comprising:

a housing with motion restricted to less than 360°;

a rotor for accepting drive force and connection to a shaft coaxially located within the housing, the housing and the rotor defining at least one vane separating a chamber in the housing into an advance chamber and a retard chamber, the vane being capable of rotation to shift the relative angular position of the housing and the rotor;

a spool valve comprising a spool having at least two lands separated by a central spindle, slidably mounted within a sleeve received by a bore, and a plurality of check valves; and a passage from the advance chamber to a port in the spool valve and a passage from the retard chamber to a port in the spool valve, such that when the spool is in the first position, fluid from the advance chamber flows through the passage and the port to the bore surrounding the central spindle of the spool valve and through a first check valve within the spool valve and port to the passage to the retard chamber and when the spool is in the second position, fluid from the retard chamber flows through the passage and the port to the bore surrounding the central spindle of the spool valve and through a second check valve within the spool valve and port to the passage to the advance chamber;

wherein when the spool is in the third position, the passage from the advance chamber to the port in the spool is blocked by the second check valve within the spool valve and the passage from the retard chamber to the port in the spool valve is blocked by the first check valve within the spool valve.

20. The rotary actuator of claim 19, wherein the plurality of check valves are located between the at least two lands separated by a central spindle of the spool.

21. The rotary actuator of claim 19, wherein the plurality of check valves are located within the sleeve of the rotor.

22. The rotary actuator of claim 19, wherein the plurality of check valves are located within the at least two lands of the spool.

23. The rotary actuator of claim 22, wherein the at least two lands of the spool further comprise plugs.

24. The rotary actuator of claim 19, wherein the bore and the sleeve are remote from the rotor.

25. The rotary actuator of claim 19, wherein the plurality of check valves are comprised of a spring and a disc.

26. The rotary actuator of claim 19, wherein the plurality of check valves are comprised of a spring and a ball.

27. The rotary actuator of claim 19, wherein the plurality of check valves are comprised of a steel band.

28. A rotary actuator for an internal combustion engine having at least one camshaft comprising:

a housing with motion restricted to less than 360°;

a rotor for accepting drive force and connection to a shaft coaxially located within the housing, the housing and the rotor defining at least one vane separating a chamber in the housing into an advance chamber and a retard chamber, the vane being capable of rotation to shift the relative angular position of the housing and the rotor;

a spool valve comprising a spool having at least two lands separated by a central spindle, slidably mounted within a sleeve received by a bore, and a plurality of check valves located between the at least two lands of the spool separated by the central spindle; and a passage from the advance chamber to a port in the spool valve and a passage from the retard chamber to a port in the spool valve, such that when the spool is in the first position, fluid from the advance chamber flows through the passage and the port to the bore surrounding the central spindle of the spool valve and through a first check valve within the spool valve and port to the passage to the retard chamber and when the spool is in the second position, fluid from the retard chamber flows through the passage and the port to the bore surrounding the central spindle of the spool valve and through a second check valve within the spool valve and port to the passage to the advance chamber;

wherein when the spool is in the third position, the passage from the advance chamber to the port in the spool is blocked by the second check valve within the spool valve and the passage from the retard chamber to the port in the spool valve is blocked by the first check valve within the spool valve.

29. The rotary actuator of claim 28, wherein the plurality of check valves are comprised of a spring and a disc.

30. The variable cam timing phaser of claim 28, wherein the plurality of check valves are comprised of a spring and a ball.

31. The variable cam timing phaser of claim 28, wherein the plurality of check valves are comprised of a steel band.

32. A rotary actuator for an internal combustion engine having at least one camshaft comprising:

a housing with motion restricted to less than 360°;

a rotor for accepting drive force and connection to a shaft coaxially located within the housing, the housing and the rotor defining at least one vane separating a chamber in the housing into an advance chamber and a retard chamber, the vane being capable of rotation to shift the relative angular position of the housing and the rotor;

a spool valve comprising a spool having at least two lands separated by a central spindle, slidably mounted within a sleeve received by a bore, and a plurality of check valves located within the bore; and a passage from the advance chamber to a port in the spool valve and a passage from the retard chamber to a port in the spool valve, such that when the spool is in the first position, fluid from the advance chamber flows through the passage and the port to the bore surrounding the central spindle of the spool valve and through a first check valve within the spool valve and port to the passage to the retard chamber and when the spool is in the second position, fluid from the retard chamber flows through the passage and the port to the bore surrounding the central spindle of the spool valve and through a second check valve within the spool valve and port to the passage to the advance chamber;

wherein when the spool is in the third position, the passage from the advance chamber to the port in the spool is blocked by the second check valve within the spool valve and the passage from the retard chamber to the port in the spool valve is blocked by the first check valve within the spool valve.

33. The rotary actuator of claim 32, wherein the plurality of check valves are comprised of a spring and a disc.

34. The rotary actuator of claim 32, wherein the plurality of check valves are comprised of a spring and a ball.

35. The rotary actuator of claim 32, wherein the plurality of check valves are comprised of a steel band.

36. A rotary actuator for an internal combustion engine having at least one camshaft comprising:

a housing with motion restricted to less than 360°;

a rotor for accepting drive force and connection to a shaft coaxially located within the housing, the housing and the rotor defining at least one vane separating a chamber in the housing into an advance chamber and a retard chamber, the vane being capable of rotation to shift the relative angular position of the housing and the rotor;

a spool valve comprising a spool having at least two lands separated by a central spindle, slidably mounted within a sleeve received by a bore, and a plurality of check valves located within the at least two lands of the spool; and a passage from the advance chamber to a port in the spool valve and a passage from the retard chamber to a port in the spool valve, such that when the spool is in the first position, fluid from the advance chamber flows through the passage and the port to the bore surrounding the central spindle of the spool valve and through a first check valve within the spool valve and port to the passage to the retard chamber and when the spool is in the second position, fluid from the retard chamber flows through the passage and the port to the bore surrounding the central spindle of the spool valve and through a second check valve within the spool valve and port to the passage to the advance chamber;

wherein when the spool is in the third position, the passage from the advance chamber to the port in the spool is blocked by the second check valve within the spool valve and the passage from the retard chamber to the port in the spool valve is blocked by the first check valve within the spool valve.

37. The rotary actuator of claim 36, wherein the at least two lands of the spool further comprise plugs.

38. The rotary actuator of claim 36, wherein the plurality of check valves are comprised of a spring and a disc.

39. The rotary actuator of claim 36, wherein the plurality of check valves are comprised of a spring and a ball.

40. The variable cam timing phaser of claim 36, wherein the plurality of check valves are comprised of a steel band.

41. A spool valve for a rotary actuator for an internal combustion engine having at least one shaft comprising: a housing with motion restricted to less than 360 degrees and a rotor for accepting drive force and connection to a shaft, the housing and the rotor defining at least one vane separating a chamber in the housing into an advance chamber and a retard chamber, the vane being capable of rotation to shift the relative angular position of the housing and the rotor; the spool valve comprising:

a spool having at least two lands separated by a central spindle, slidably mounted within a sleeve received by a bore, and a plurality of check valves; and a passage from the advance chamber to a port in the spool valve and a passage from the retard chamber to a port in the spool valve, such that when the spool is in the first position, fluid from the advance chamber flows through the passage and the port to the bore surrounding the central spindle of the spool valve and through a first check valve within the spool valve and port to the passage to the retard chamber and when the spool is in the second position, fluid from the retard chamber flows through the passage and the port to the bore surrounding the central spindle of the spool valve and through a second check valve within the spool valve and port to the passage to the advance chamber;

wherein when the spool is in the third position, the passage from the advance chamber to the port in the spool is blocked by the second check valve within the spool valve and the passage from the retard chamber to the port in the spool valve is blocked by the first check valve within the spool valve.

42. The spool valve of claim 41, wherein the plurality of check valves are located between the at least two lands separated by a central spindle of the spool.

43. The spool valve of claim 41, wherein the plurality of check valves are located within the sleeve of the rotor.

44. The spool valve of claim 41, wherein the plurality of check valves are located within the at least two lands of the spool.

45. The spool valve of claim 44, wherein the at least two lands of the spool further comprise plugs.

46. The spool valve of claim 41, wherein the bore and the sleeve are remote from the rotor.

47. The spool valve of claim 41, wherein the plurality of check valves are comprised of a spring and a disc.

48. The spool valve of claim 41, wherein the plurality of check valves are comprised of a spring and a ball.

49. The spool valve of claim 41, wherein the plurality of check valves are comprised of an elastic band.

* * * * *

UNITED STATES PATENT AND TRADEMARK OFFICE

CERTIFICATE OF CORRECTION

PATENT NO. : 7,000,580 B1
APPLICATION NO. : 10/952054
DATED : February 21, 2006
INVENTOR(S) : Smith et al.

It is certified that error appears in the above-identified patent and that said Letters Patent is hereby corrected as shown below:

Column 11, line 38: delete “variable cam timing phaser” and add --rotary actuator--.

Column 11, line 41: delete “variable cam timing phaser” and add --rotary actuator--.

Column 12, line 57: delete “variable cam timing phaser” and add --rotary actuator--.

Signed and Sealed this

Fourth Day of December, 2007

JON W. DUDAS
*Director of the United States Patent and Trademark Office*